US006944916B2

(12) United States Patent
Kawagoe

(10) Patent No.: US 6,944,916 B2
(45) Date of Patent: Sep. 20, 2005

(54) LENGTH ADJUSTMENT DEVICE OF BAND-SHAPED ORNAMENT

(75) Inventor: Shiro Kawagoe, Kokubunji (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 10/469,995

(22) PCT Filed: Mar. 18, 2002

(86) PCT No.: PCT/JP02/02536

§ 371 (c)(1),
(2), (4) Date: Sep. 16, 2003

(87) PCT Pub. No.: WO02/074124

PCT Pub. Date: Sep. 26, 2002

(65) Prior Publication Data

US 2004/0083581 A1 May 6, 2004

(30) Foreign Application Priority Data

Mar. 19, 2001 (JP) ..... 2001-077931

(51) Int. Cl.[7] ..... A44C 5/24
(52) U.S. Cl. ..... 24/71 J; 24/70 J; 24/265 WS
(58) Field of Search ..... 24/68 R, 71 R, 24/68 E, 265 R, 69 J, 265 H, 71 ST, 265 BC, 71 J, 265 EC, 68 J, DIG. 47, DIG. 48, 70 R, 70 SK, 70 ST, 70 J, 265 WS, 265 E; 224/176, 177; 368/282

(56) References Cited

U.S. PATENT DOCUMENTS 4,675,955 A * 6/1987 Nakamura ..... 24/656
5,787,554 A * 8/1998 Hashimoto ..... 24/68 J
6,182,298 B1 * 2/2001 Dampney ..... 2/422

FOREIGN PATENT DOCUMENTS

| | | | |
|---|---|---|---|
| JP | 7-30727 | 6/1995 | |
| JP | 07222611 | 8/1995 | |
| JP | 07222611 A * | 8/1995 | ..... A44C/5/24 |
| JP | 2589222 | 1/1999 | |
| JP | 2000-279217 | 10/2000 | |
| JP | 2000279217 | 10/2000 | |
| WO | 94/22340 | 10/1994 | |

* cited by examiner

*Primary Examiner*—James R. Brittain
(74) *Attorney, Agent, or Firm*—Dennison, Schultz, Dougherty & MacDonald

(57) ABSTRACT

A device for adjusting length of a personal adornment band includes a guide connected to an end of the personal adornment band, a length adjusting section connected to the other end of the personal adornment band and movably provided in the longitudinal direction of the personal adornment band and guided by the guide, a manipulating member movably provided in the longitudinal direction of the personal adornment band and guided by the guide, an operation transmitting portion provided in the manipulating member, at least one stopper member for making a contact with a part of the length adjusting section to stop the length adjusting section, and an operation changing means provided at a contact between the manipulating member and the stopper member.

36 Claims, 26 Drawing Sheets

LENGTH ADJUSTMENT DEVICE OF BAND-SHAPED ORNAMENT

TECHNICAL FIELD

The present invention relates to a device for adjusting length of a personal adornment band such as a watchband and a bracelet.

BACKGROUND ART

There has been known various buckles each provided with a device for adjusting length of a personal adornment band such as a wristwatch and a bracelet. A publication of Japanese Utility Model No. 2582413 discloses a triple-folded buckle for a watchband where length thereof is adjusted in a longitudinal direction of the band.

The triple-folded buckle is housed in a surface cover and is provided with an adjusting device retractable in the surface cover. A pair of pushbuttons retractable in a lateral direction of the band is further provided in the surface cover. The pushbuttons are urged by a spring so as to project out of the surface cover. An engagement member of each push button thus urged engages with one of consecutive engaging teeth formed in length adjusting plate so that the movement of the length adjusting plate is restricted.

When the pushbuttons are depressed with fingers against the urging of the spring, the engagement member is released from the engagement teeth, thereby to enable the length adjusting plate to be retracted in the surface cover or projected therefrom. When the fingers are released from the pushbuttons, the pushbuttons are urged by the spring so as to be moved outward and again abut against the length adjusting plate. Thus, the length adjusting plate is stopped.

The triple-folded buckle is thus advantageous in arbitrarily adjusting the position of the buckle in the longitudinal direction of the band.

However, in the buckle disclosed in Japanese Utility Model No. 2582413, the pushbuttons may be pushed toward the surface cover when the wrist is inwardly bent. Accordingly, the length adjusting plate is accidentally moved in spite of the intension of the wearer. More particularly, when the length adjusting plate is accidentally pulled out from the surface cover, the watch is disengaged from the wrist and falls off.

There has recently been commonly used a lock device for locking a triple-folded buckle in a closed position, as shown in Japanese Patent Application Laid-Open No. 10-327914, where a pair of pushbuttons retractable in a lateral direction of the band are provided in a surface cover. The lock device is released when the pushbuttons are depressed so that the buckle opens from the closed position.

When such a lock device is provided in the surface cover with the length adjusting device, it becomes difficult to distinguish the pushbuttons for the lock device from those of the length adjusting device so that erroneous operations tends to occur.

A first object of the present invention is to provide a device for adjusting length where a length adjusting plate is prevented from becoming accidentally disengaged which causes personal adornment band to be loosened.

A second object of the present invention is to provide a device for adjusting length where mishandling by a user is prevented and the operability of the device is improved.

DISCLOSURE OF THE INVENTION

According to the present invention, there is provided a device for adjusting length of a personal adornment band comprising a guide means connected to an end of the personal adornment band, a length adjusting section connected to another end of the personal adornment band and movably provided in a longitudinal direction of the personal adornment band and guided by the guide means, a manipulating member provided in the guide means so as to be moved in the longitudinal direction of the personal adornment band, an operation transmitting portion provided in the manipulating member, at least one stopper member for making contact with a part of the length adjusting section to stop the length adjusting section, and an operation changing means provided at a contact portion between the manipulating member and the stopper member, the operation changing means being provided for moving the stopper member in a lateral direction of the band so as to contact the stopper member with the length adjusting section to lock the length adjusting section when the manipulating member is moved in one of longitudinal directions, and for moving the stopper member in another lateral direction to release the stopper member from the length adjusting section when the manipulating member is moved in another longitudinal direction.

In accordance with the construction, by moving the manipulating member in one direction, the length adjusting section becomes immovable. When the manipulating member is moved in the other direction, the length adjusting section becomes movable, and by moving the length adjusting section, the length in the longitudinal direction of the band can be adjusted.

Since the moving direction of the manipulating member is set in the longitudinal direction of the personal adornment band, the manipulating member is not accidentally moved although the wrist may be bent inward or the manipulating member may be depressed along the lateral direction of the band.

Furthermore, when a lock device is also disposed in a buckle provided with push buttons retractable in the lateral direction of the personal adornment band, since the depressing directions of the manipulating member and the push buttons differ from each other, mishandling thereof is prevented.

In an aspect of the present invention, the guide means is a housing and the operation changing means comprises the operation transmitting portion projecting from the manipulating device and an inclined surface formed in the stopper member.

In accordance with a first embodiment of the present invention, the length adjusting section has a pair of engaging saw teeth formed in the longitudinal direction of the personal adornment band, and a pair of stopper members, each stopper member comprises a member having a pawl which moves in the lateral direction of the personal adornment band and engages with one of the engaging teeth, and two operation transmitting portions each adapted to operate the stopper member are provided.

A first spring is provided for urging the manipulating member in one of the directions between a recess formed in the manipulating member and the housing.

A second spring is provided to urge the stopper member in a direction in which the stopper member abuts against the operation transmitting portion of the length adjusting section.

These and other objects and features of the present invention will become more apparent from the following detailed description with reference to the accompanying drawings.

BEST MODE FOR EMBODYING THE INVENTION

A personal adornment band referred to in the present invention includes all of the elements that compose the band. Namely, besides the band, a buckle for expanding the circumference of the band, and in the case of a watch, a case for housing a movement therein are included. A first embodiment of the present invention, which is hereinafter described, is an example where a device for adjusting length is provided in a buckle.

Each of the embodiments hereinafter described are adapted to a band for a watch, and hence the band comprises a pair of bands.

Figure 1:
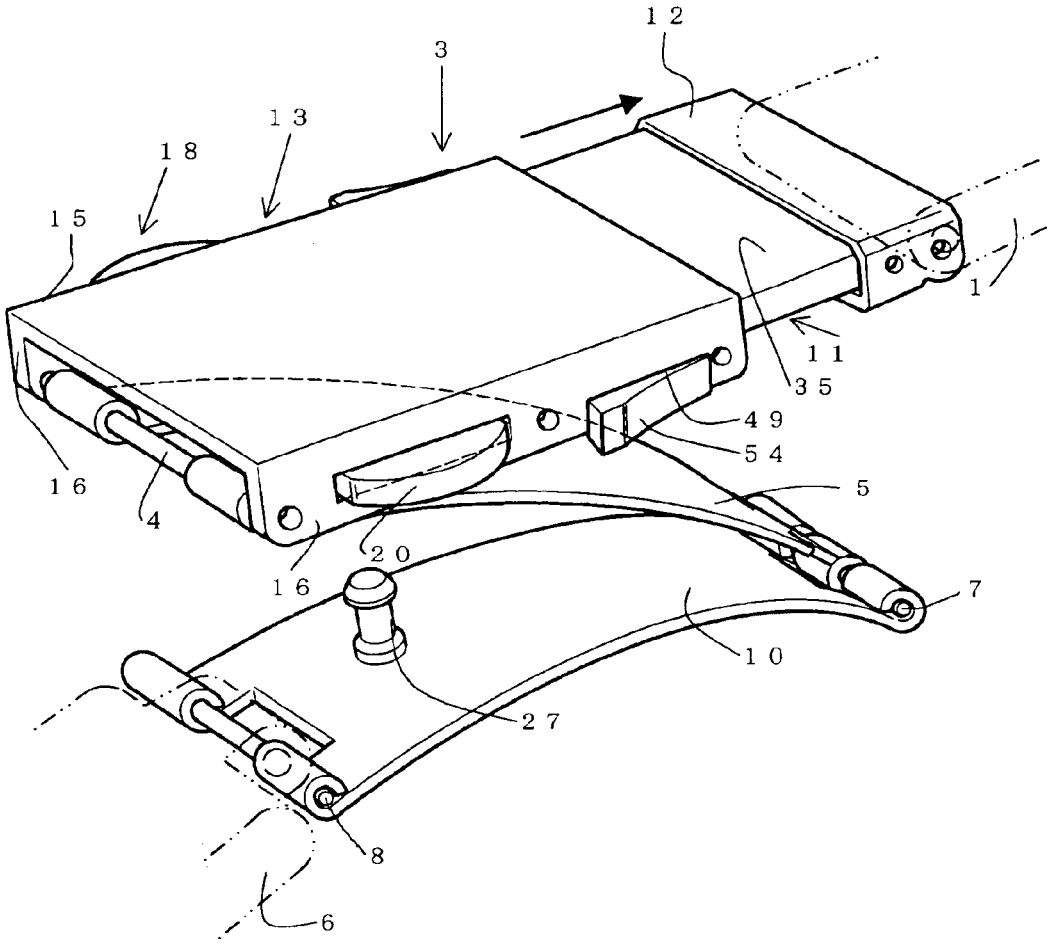
FIG. 1 is a perspective view of a device for adjusting length of a watch band adapted to a buckle, usually referred to as a triple-folded buckle.
Figure 2:
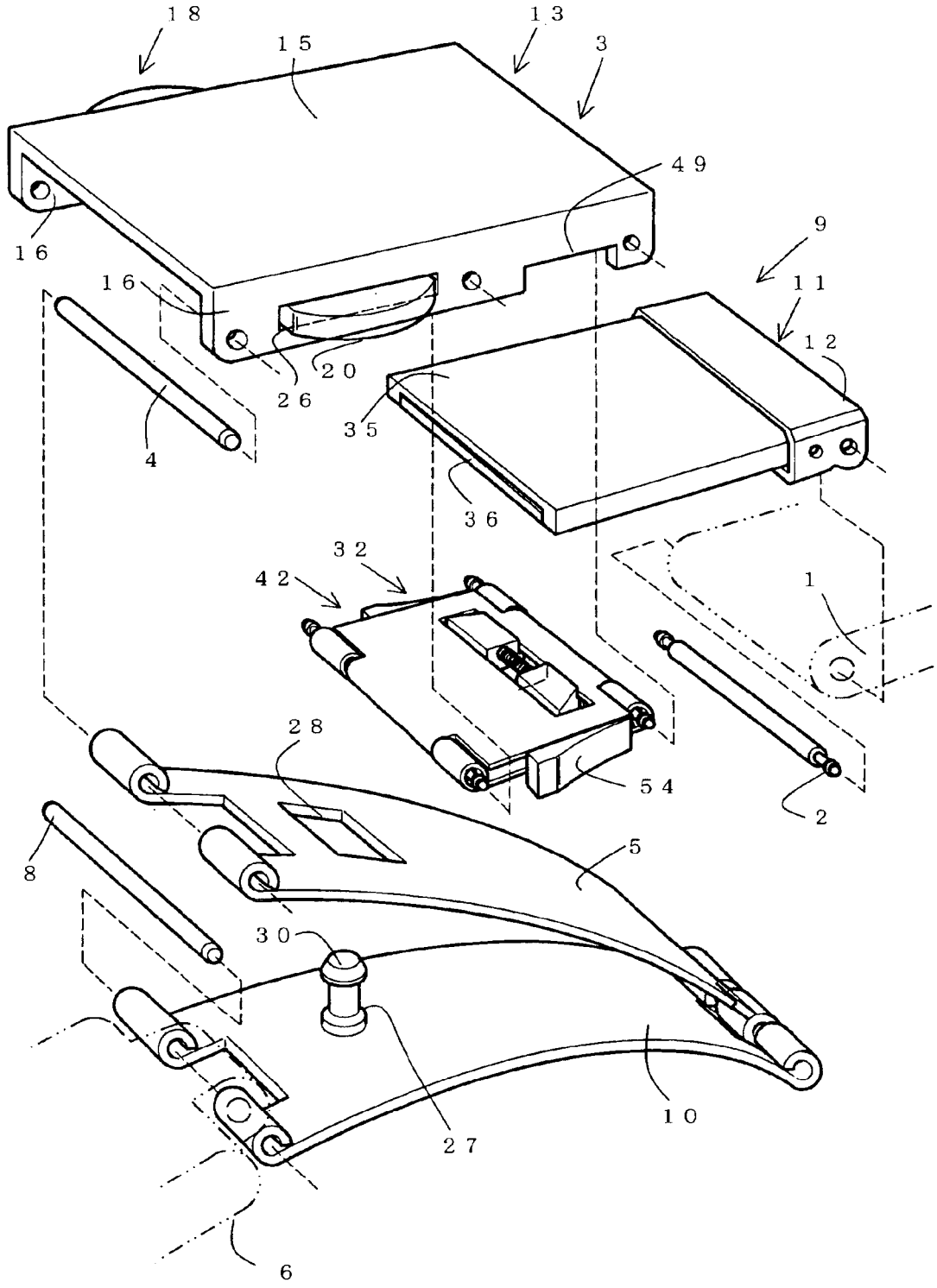
FIG. 2 is an exploded perspective view of the device.
Figure 3:
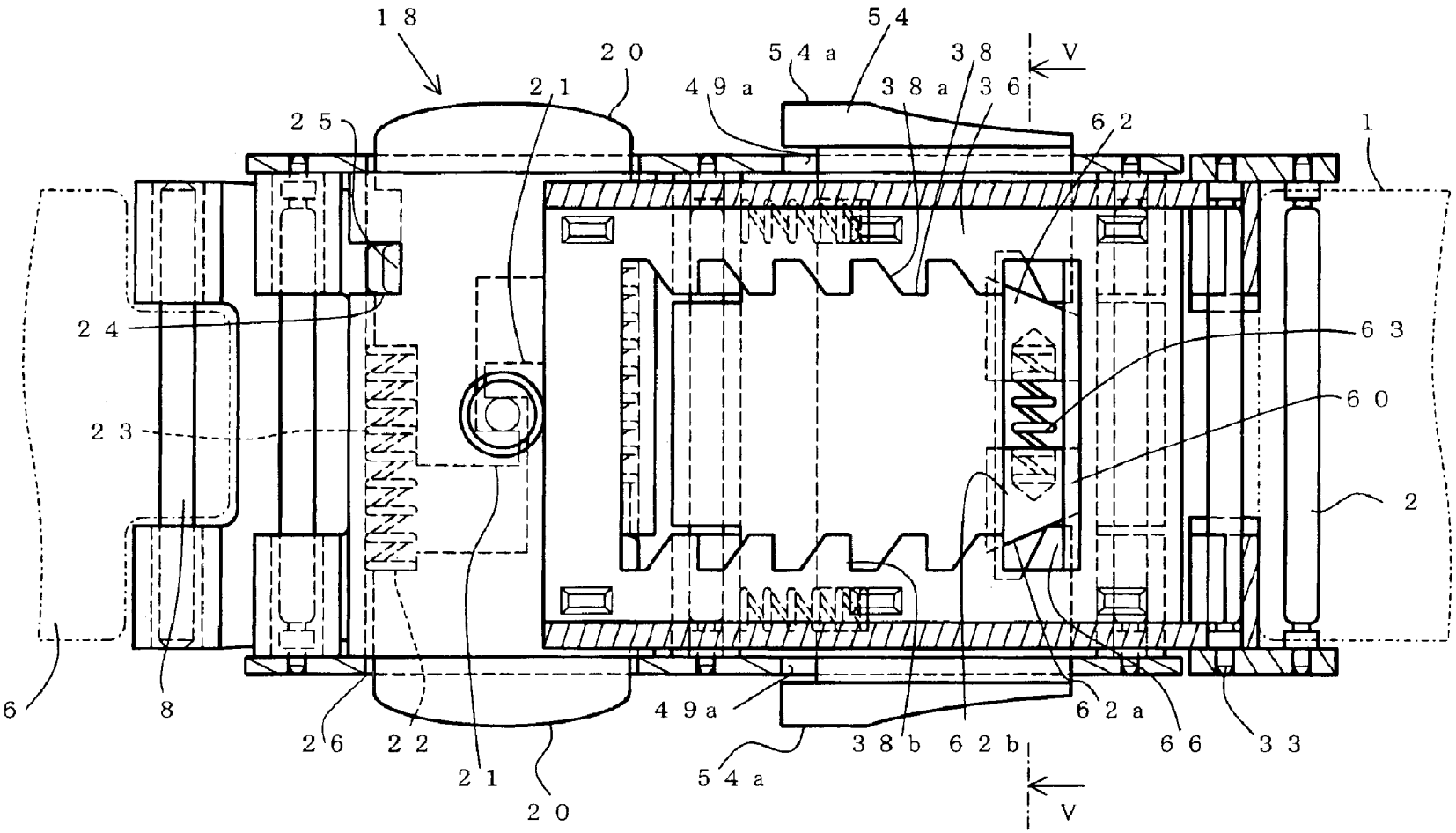
FIG. 3 is a sectional plan view of the device.
Figure 4:
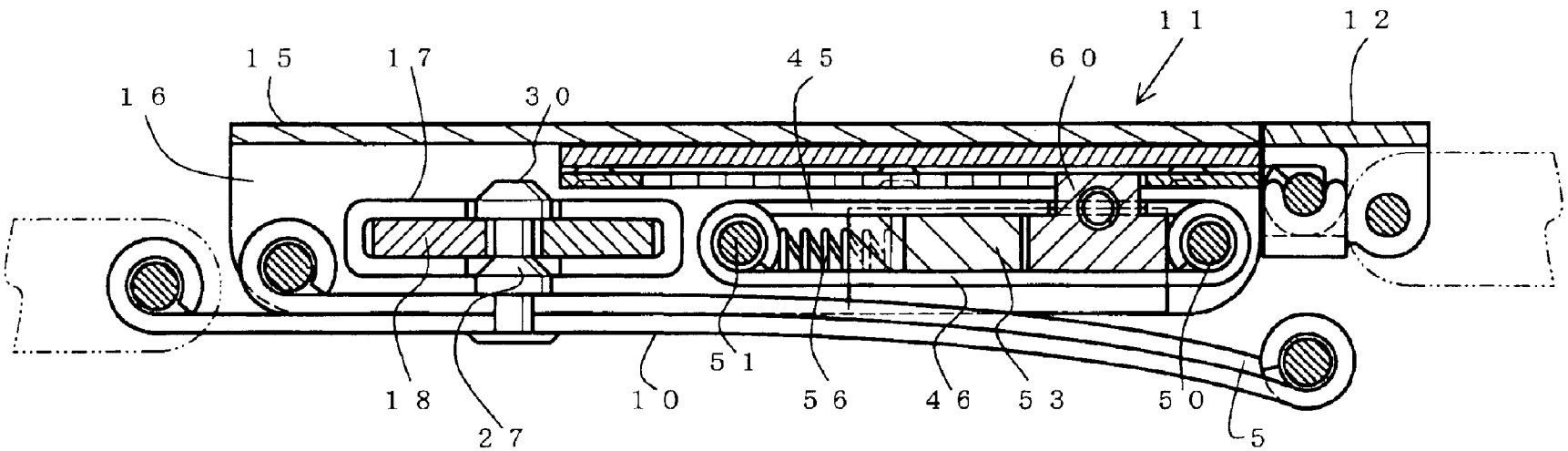
FIG. 4 is a sectional side view of the device.
Figure 5:
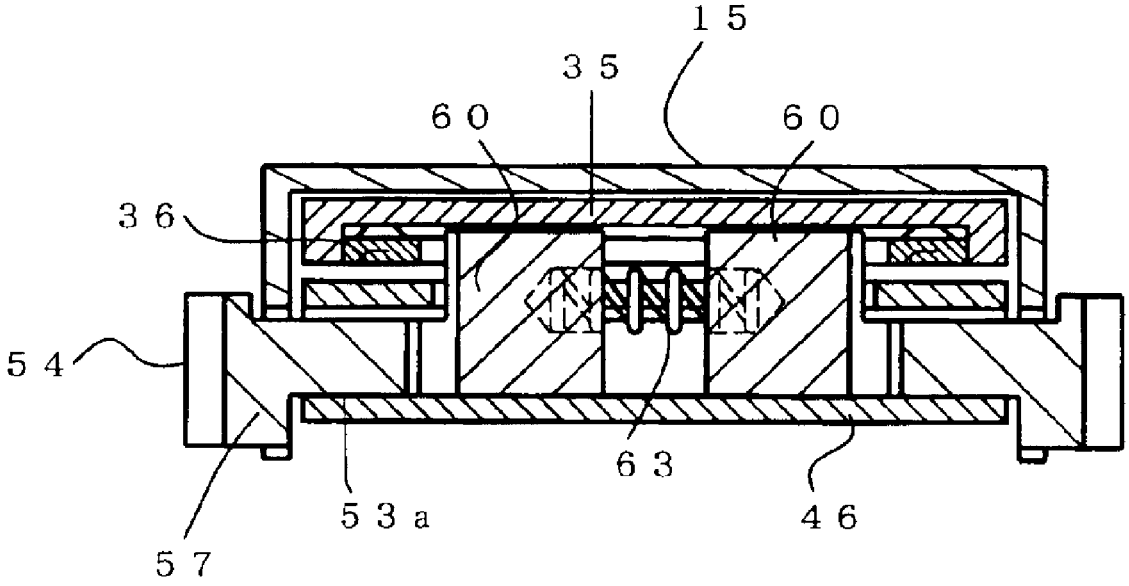
FIG. 5 is a sectional view taken along a line V—V of FIG. 3.

FIG. 1 is a perspective view of a device for adjusting the length of a watch band adapted to a buckle, usually referred to as a triple-folded buckle, FIG. 2 is an exploded perspective view of the device, FIG. 3 is a sectional plan view of the device, FIG. 4 is a sectional side view, and FIG. 5 is a sectional view taken along a line V—V of FIG. 3.

A length adjusting device 9 of the present invention is provided in a buckle disposed between a band 1 and another band 6. Namely, the buckle has an upper structure 3 connected to the band 1 by way of a guiding and length adjusting section 11, which will be later described, by a spring-loaded pin 2, a middle plate 5 connected to the upper structure 3 by a pin 4, and a lower plate 10 connected to the middle plate 5 and the band 6 by pins 7 and 8, respectively. The upper structure 3 has a surface cover 13 in which are provided the guiding and length adjusting section 11 and a manipulating mechanism 32 for releasing and locking the length adjusting section 11.

A lock device of the buckle is described before describing the main part of the present invention. The surface cover 13 comprises an upper plate 15 and a pair of side plates 16. A supporting frame 17 having an elongated annular shape in section as shown in FIG. 4 is secured between the side plates 16, and a pair of right and left push buttons 18 are slidably inserted and supported in the frame. The push buttons 18 are formed in point symmetry as shown in FIG. 3, each having a manipulating portion 20 at the base and a hook portion 21 at the end thereof. A spring 23 is disposed between shoulders 22 of the push buttons so that the push buttons are urged outward of the surface cover. A shoulder 24 of each push button abuts against a stopper 25 projecting from the supporting frame 17 so that the urging of the push buttons is stopped and the push buttons are held in positions where each of the manipulating portions 20 slightly protrudes out of an opening 26 formed in the side plate 16.

On the other hand, a lock pin 27 is projected from the lower plate 10 so that when the buckle is closed, the lock pin 27 passes through an opening 28 formed in the middle plate 5, thereby rendering a conical trapezoidal head 30 of the pin to press the hook portions 21 of the push buttons 18 in order to press open the push buttons outward against the urging of the springs 23. When the head 30 passes the hooks 21, the push buttons are retracted by the springs 23 so that the head 30 engages the hooks to lock the buckle.

In order to open the buckle, the manipulating portions 20 of the push buttons 18 are simultaneously pressed inward, so that the hook portions 21 are disengaged from the lock pin 27, thereby enabling to open the buckle.

The length adjusting device 9 of the present invention is disposed adjacent the above described lock device. The length adjusting device comprises the length adjusting section 11 and the manipulating mechanism 32.

Figure 6:
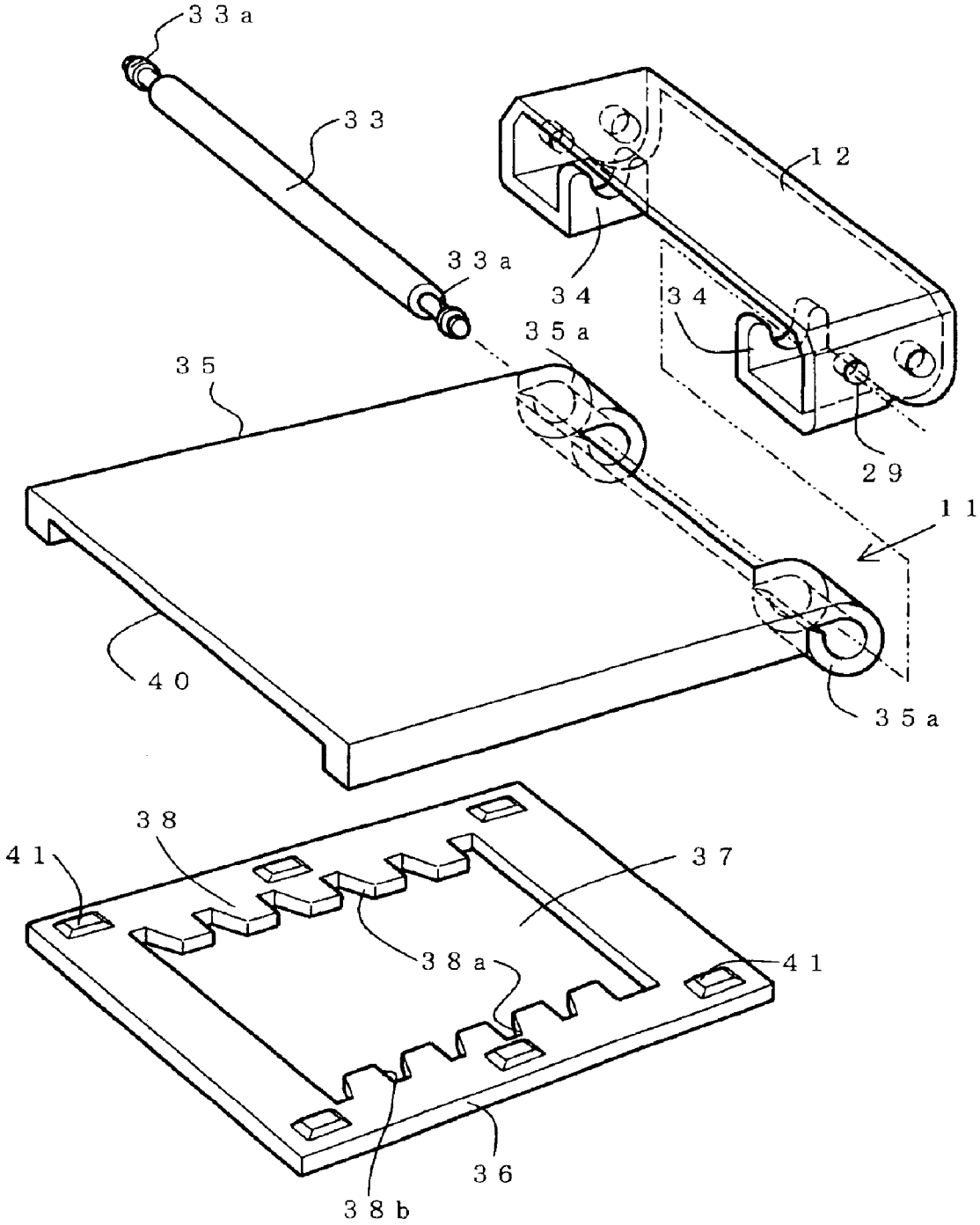
FIG. 6 is an exploded perspective view of the length adjusting section.
Figure 7:
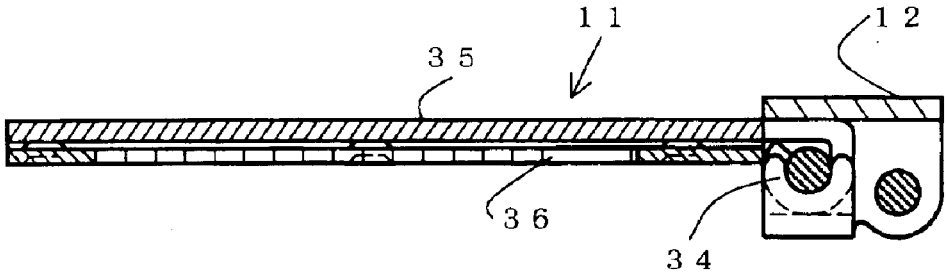
FIG. 7 is a sectional view taken along the longitudinal direction thereof.
Figure 8:
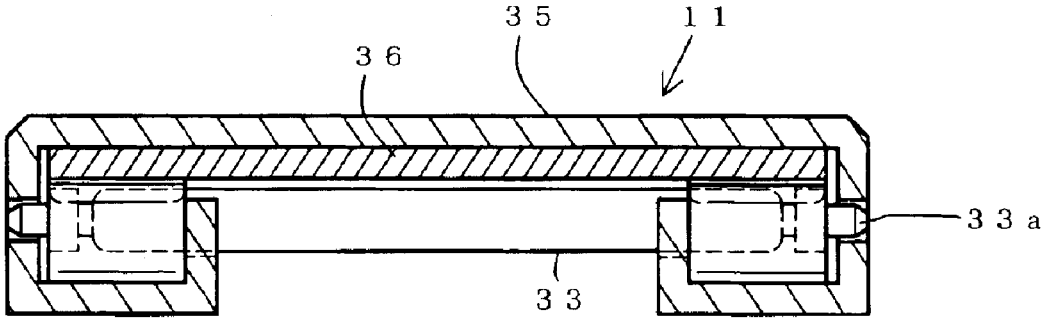
FIG. 8 is a sectional view taken along, the lateral direction thereof.
Figure 9:
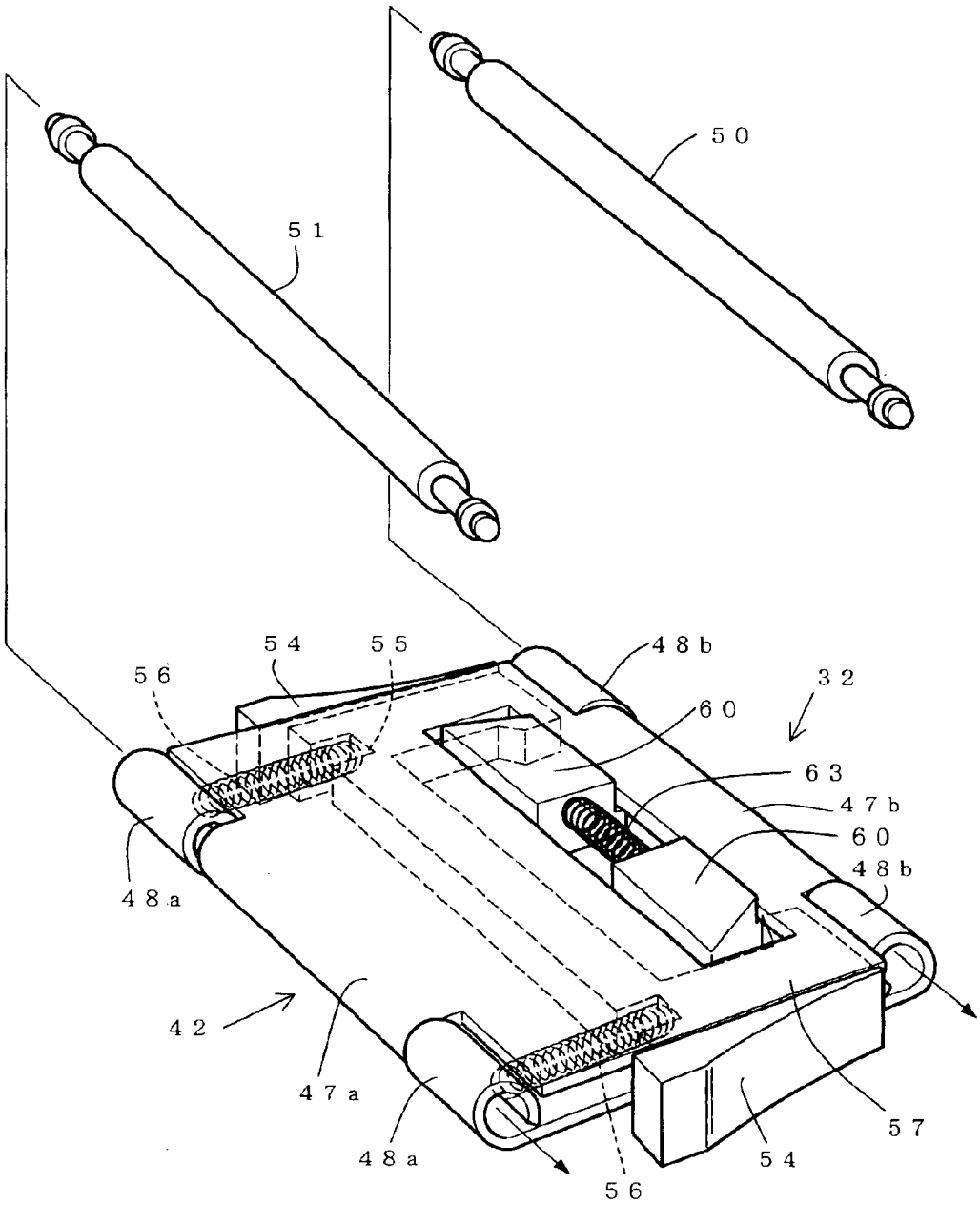
FIG. 9 is a perspective view of a manipulating mechanism.
Figure 10:
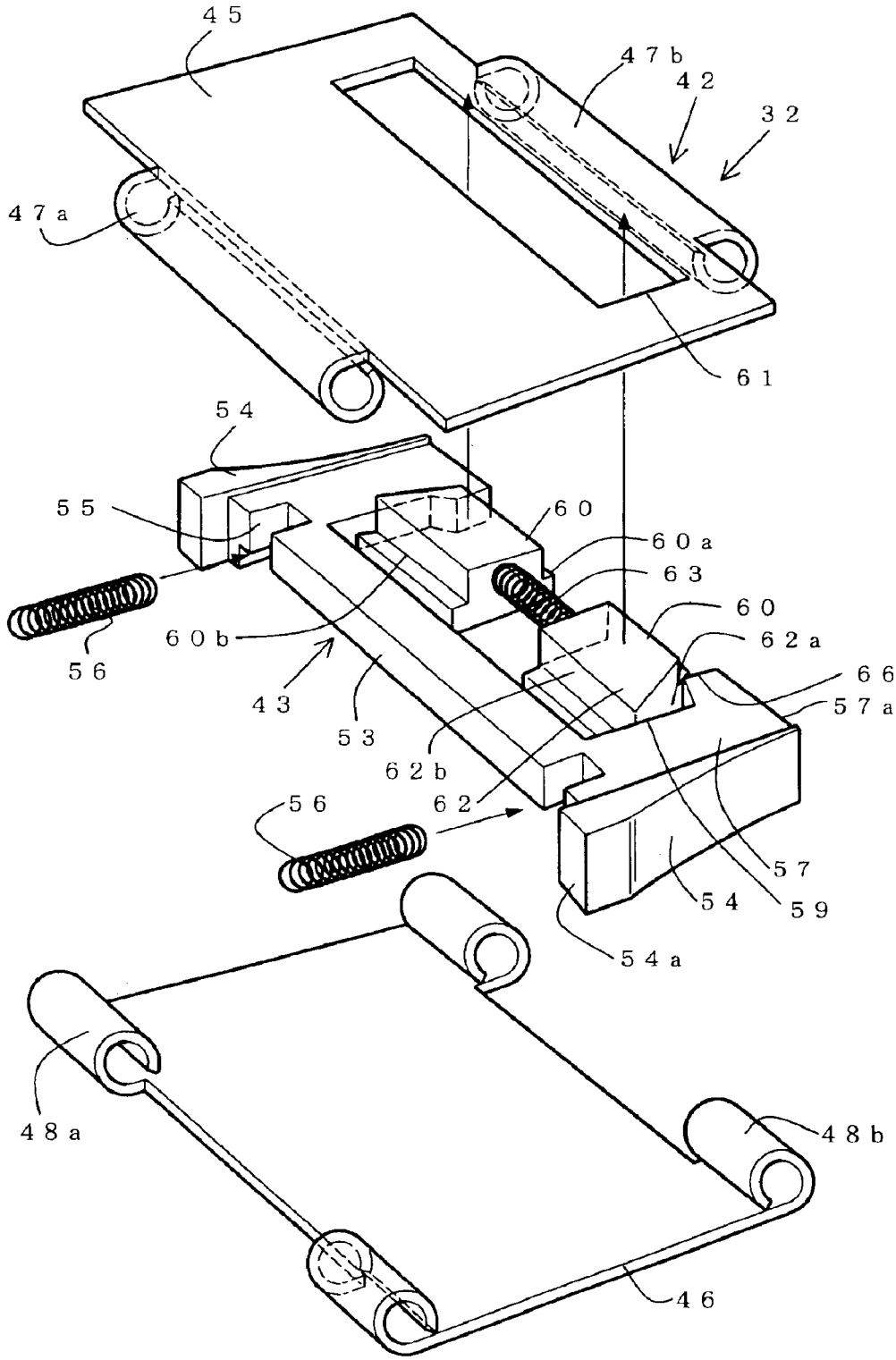
FIG. 10 is an exploded perspective view thereof.
Figure 11:
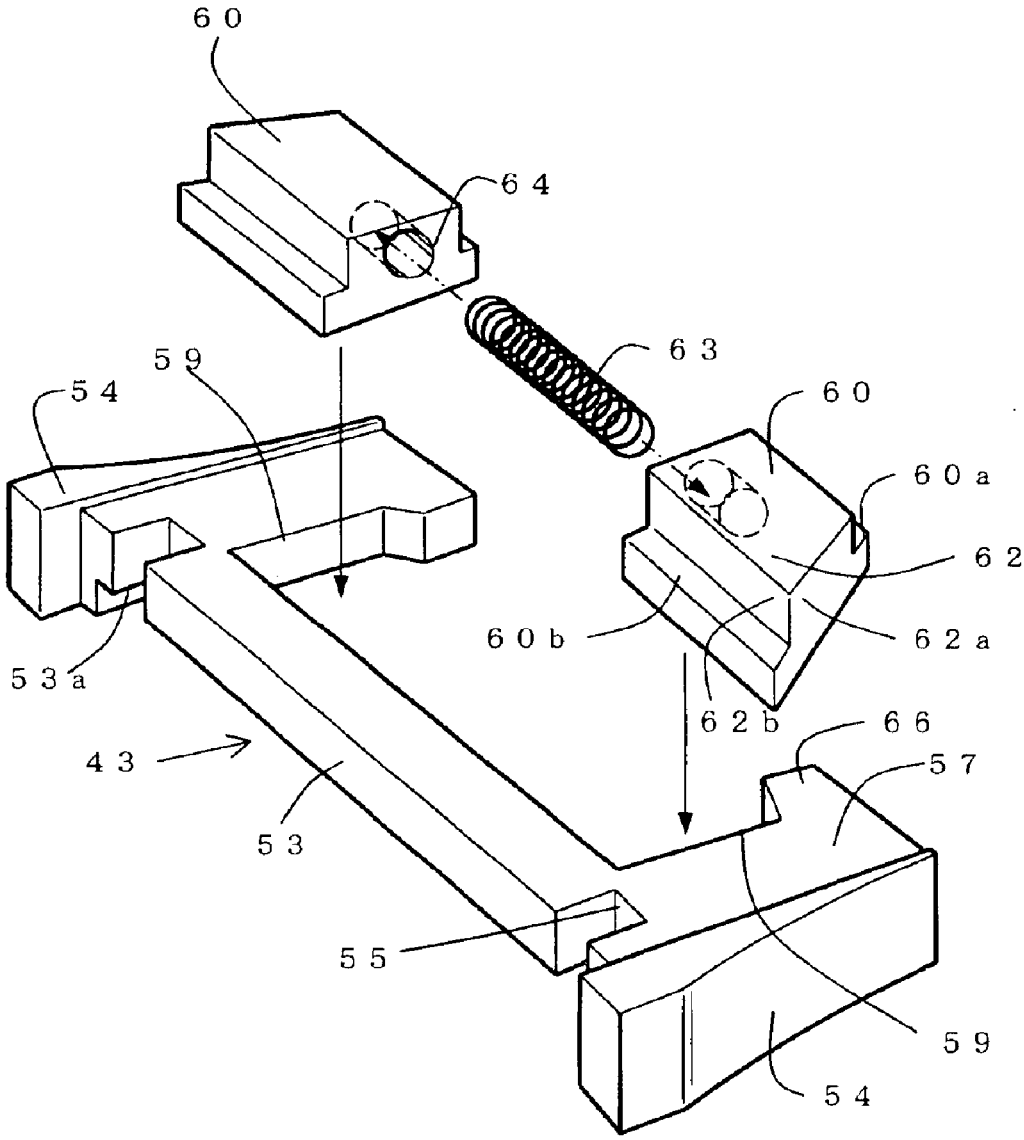
FIG. 11 is an exploded perspective view showing a part thereof.

FIG. 6 is an exploded perspective view of the length adjusting section, FIG. 7 is a sectional view taken along the longitudinal direction thereof, FIG. 8 is a sectional view taken along the lateral direction thereof, FIG. 9 is a perspective view of the manipulating mechanism, FIG. 10 is an exploded perspective view thereof, and FIG. 11 is an exploded perspective view showing a part thereof.

As shown in FIGS. 6 to 8, the length adjusting section 11 comprises a connecting member 12, ceiling plate 35 and an engaging plate 36. The ceiling plate 35 has a pair of cylindrical connecting portions 35a in which a spring-loaded pin 33 is inserted so that a pair of U-shaped holding portions 34 are mounted on the spring-loaded pin. A pin 33*a* at each end of the spring-loaded pin 33 is inserted in a hole 29 of the connecting member 12 so as to connect the connecting member and the ceiling plate.

The engaging plate 36 has a rectangular opening 37 which has a plurality of engaging saw teeth 38 along both edges in the longitudinal direction of the band. The engaging plate 36 is housed in a recess 40 formed in the ceiling plate 35 and secured thereto by spot welding through a plurality of projections 41 for spot welding formed on the upper surface of the engaging plate. As shown in FIG. 3, each of the engaging teeth 38 has a surface facing the direction in which the band is expanded, that is a surface 38*b* which is parallel to the lateral side facing the band 1, and a surface facing a direction in which the band is contracted, that is a surface 38*a* which is inclined at a predetermined angle to the lateral direction facing the band 6.

As shown in FIGS. 9 to 11, the manipulating mechanism 32 comprises a housing 42, manipulating member 43 slidable in the housing in the longitudinal direction of the band, and a pair of stopper members 60 slidable in the lateral direction of the band.

The housing 42 comprises an upper plate 45 and a lower plate 46 as shown in FIG. 10, and as shown in FIG. 9, is formed into a planar box by assembling connecting cylinders 47*a*, 47*b*, 48*a*, 48*b* formed on the respective plates and inserting spring-loaded pins 50 and 51 in the connecting cylinders.

The manipulating member 43 comprises a U-shaped sliding portion 53, a pair of arms 57, a pair of operation transmitting portions 66 projecting inwardly from the ends of the arms, and a pair of depressing portions 54 projecting outward at both sides. On the underside of the sliding portion 53, there is formed a groove 53*a* as shown in FIG. 5, in which is slidably engaged the lower plate 46 of the housing 42 in a longitudinal direction of the band.

A pair of spring housing recesses 55 are formed at the lateral ends of the sliding portion 53 adjacent the depressing portions 54 so that a first spring 56 is inserted between each recess and the connecting cylinder 48*a*, thereby to urge the sliding portion 53 toward the band 1 and to abut an end 57*a* of each arm 57 of the sliding portion against the connecting cylinder 48*b*.

Each depressing portion 54 is projected outward from an opening 49 formed in the side plate 16 of the surface cover 13 shown in FIG. 2, and a depressing projection 54*a* of the depressing portion 54 prevents an edge 49*a* of the opening 49 from being exposed as shown in FIG. 3.

As shown in FIGS. 5, 9 and 10, the stopper members 60 are disposed in a recess 59 between the arms 57 of the sliding portion 53. The stopper members are so mounted on the lower plate 46 as to slide in a lateral direction of the band. The upper surface of each stopper member projects upward from an opening 61 of the upper plate 45 and shoulders 60*a* and 60*b* formed at the end surfaces of the stopper member 60 in the lateral direction of the band are slidably held on the lower surface of the upper plate 45. A pawl 62 extending outward in a triangle is formed on each stopper member 60. Each pawl 62 has an engaging surface 62*b* parallel to the lateral direction of the band, and an inclined surface 62*a* inclined in a predetermined angle to the lateral direction of the band. The inclined surface 62*a* also serves as an operating direction changing surface. A second spring 63 is provided between cavities 64 (FIG. 11) which are formed in side surfaces of the pawls so as to urge the pawls outward of the surface cover in the lateral direction of the band. The pawls protrudes out of the opening 61 formed in the upper plate 45 in the lateral direction of the band so that the movements of the pawls are guided by the opening 61 and each stopper member 60 is guided so as to move in the lateral direction of the band.

Each operation transmitting portion 66 of the manipulating member 43 abuts on the inclined surface 62*a* of the pawl 62, thereby enabling to change the movement of the operation transmitting portions 66 in the longitudinal direction of the band into a movement in the lateral direction. Namely, the transmitting portions 66 and the inclined surfaces 62*a* constitute an operation changing means.

The housing 42 is attached to the side plates 16 of the surface cover 13 by spring-loaded pins 50 and 51, and the ceiling plate 35 of the length adjusting section 11 and the engaging plate 36 integral thereto, are slidably inserted between the upper plate 45 of the manipulating mechanism 32 and the upper plate 15 of the surface cover 13 as shown in FIG. 4.

As shown in FIG. 3, each pawl 62 abuts against one of the inclined surfaces 38*a* of the engaging teeth 38 and the engaging surface 62*b* thereof abuts against the engaging surface 38*b*.

Therefore, in such a state, the engaging plate 36 and the ceiling plate 35 of the length adjusting section 11 are prevented from moving in a longitudinal direction of the band, and hence the length of the band cannot be changed.

In order to put the band on a wrist of a user by operating the buckle, the push buttons 18 are simultaneously depressed inward as described above, so that the hook portions 21 of the pushbuttons 18 are disengaged from the lockpin 27. The surface cover 13 is lifted so as to open the middle plate 5, so that the band can be let out. Next, the extended band is worn on the wrist and the surface cover 13 is depressed against the lower plate 10 so that the hook portions 21 of the push buttons 18 engage the lock pin 27, thereby locking the buckle.

The operation for adjusting the length of the band when the annular size of the band does not conform to the diameter of the wrist is described hereinafter.

Figure 12:
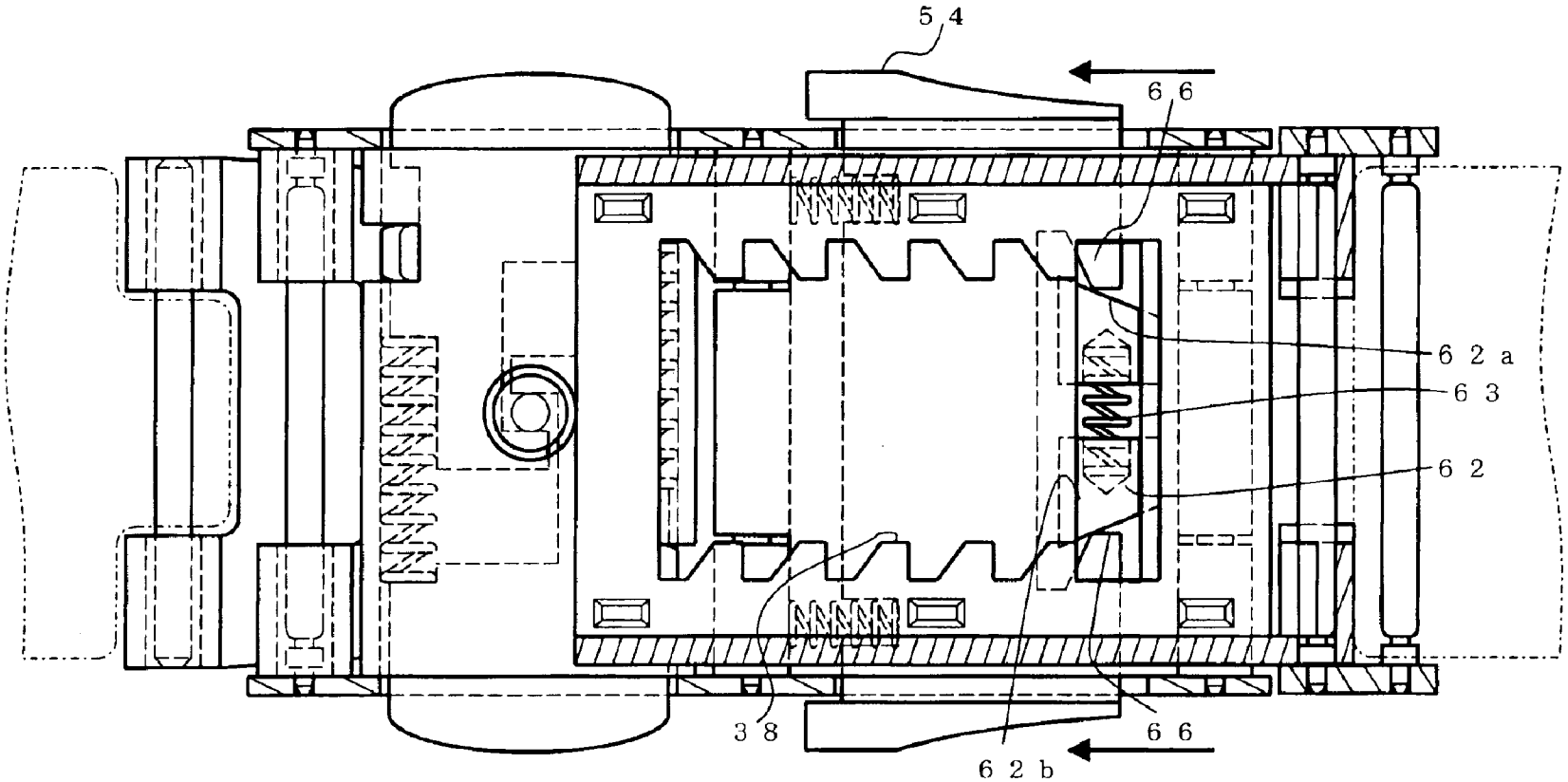
FIGS. 12 to 14 are sectional plan view for explaining the operation thereof.

Referring to FIG. 3, the depressing portions 54 are held between the thumb and forefinger and thrust to the left. Each operation transmitting portion 66 between the arms 57 abuts on the inclined surface 62*a* of each pawl 62, which constitutes an operational direction converting surface, thereby pushing the surface, so that the pawl is displaced inward against the urging of the spring 63, thereby moving the stopper member 60 inward. As shown in FIG. 12, the engaging surface 62*b* of each pawl thus disengages from the engaging teeth 38 of the engaging plate 36 provided in the length adjusting section 11. Hence the locking of the engaging plate 36 is released, thereby enabling to move the plate.

Figure 13:
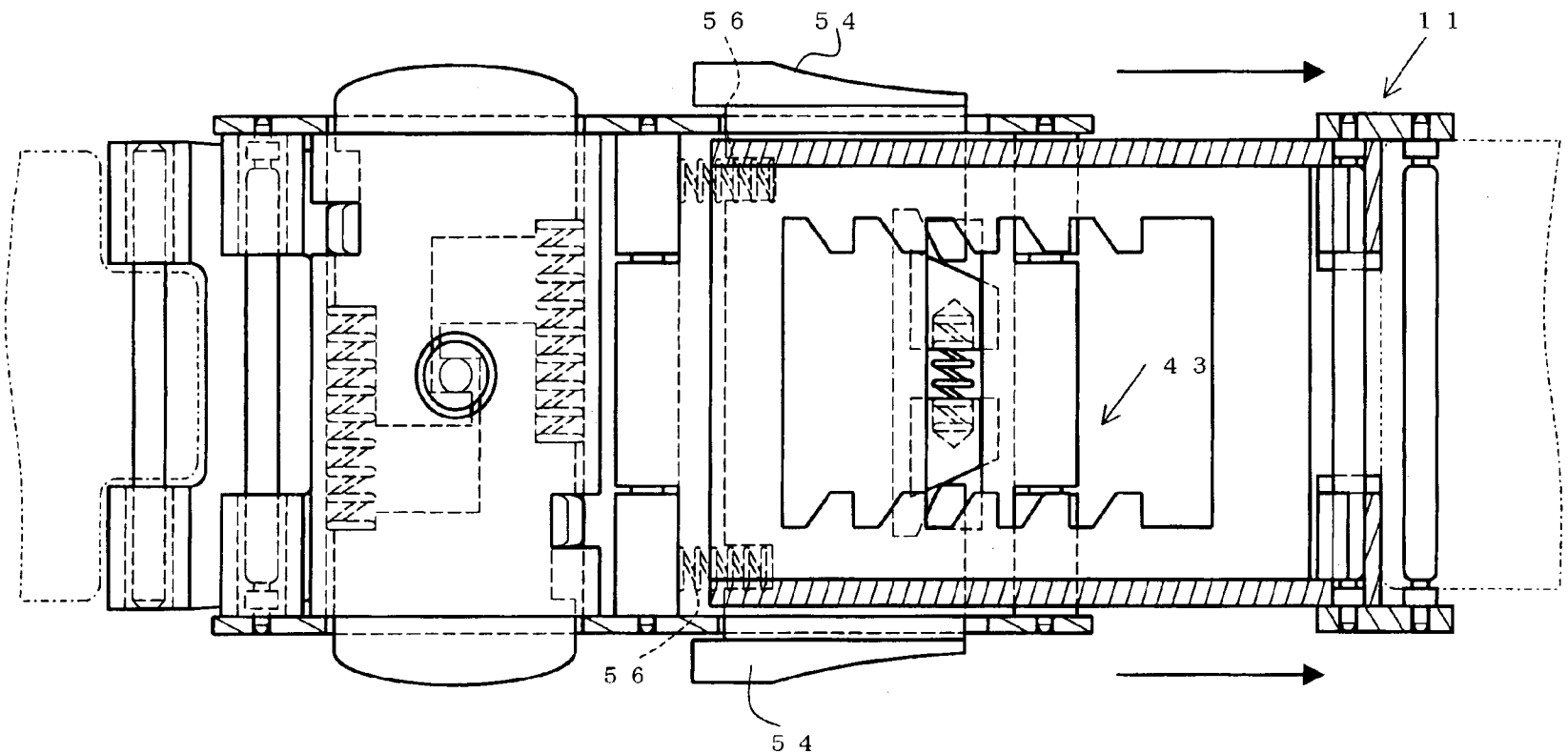
Figure 14:
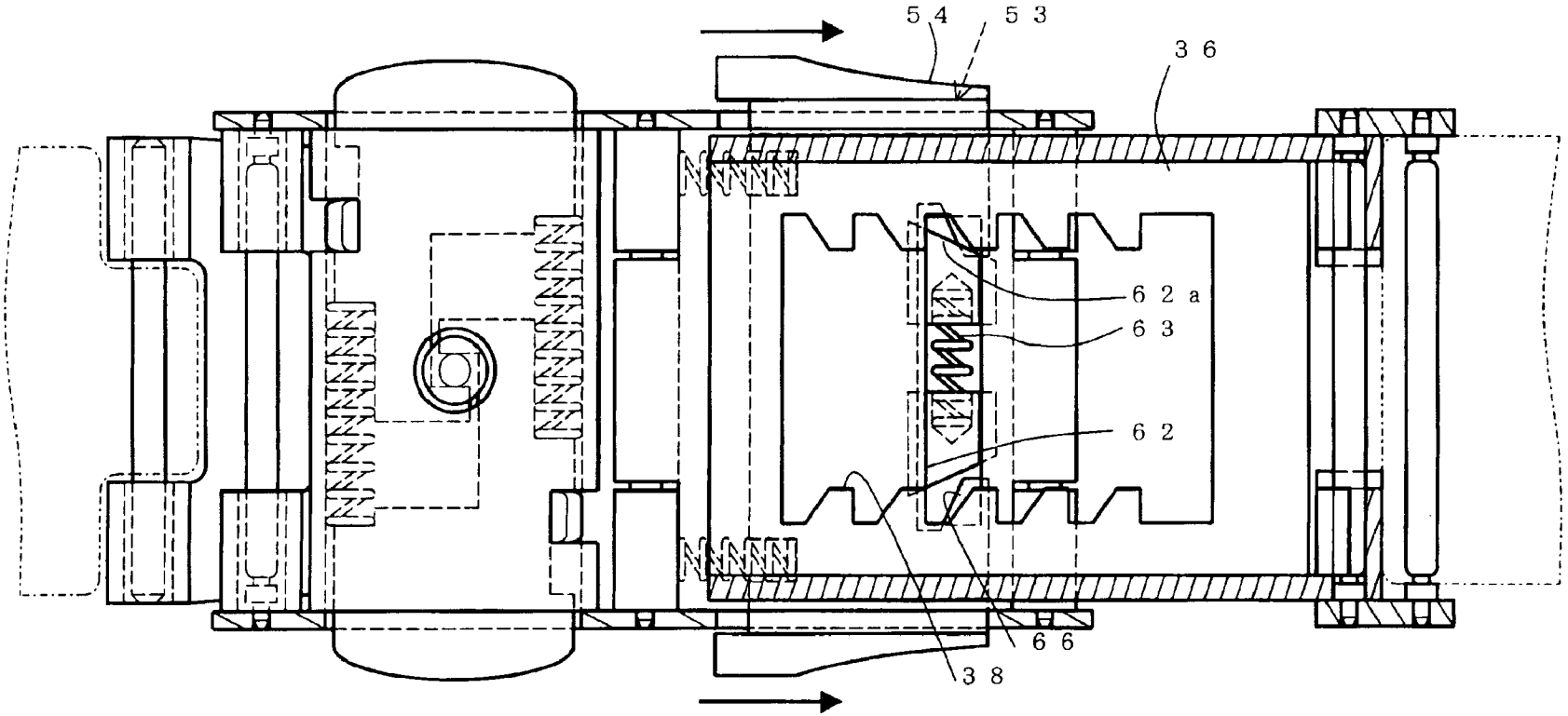

The depressing portions 54 remain depressed and in the case the band is tight, the length adjusting section 11 is pulled out as shown in FIG. 13, and in the case the band is loose, pushed in to obtain an appropriate length. The fingers are then released from the depressing portions 54 so that the manipulating member 43 returns to the initial position by the springs 56. Accordingly, as shown in FIG. 14, the operation transmitting portions 66 of the sliding portion 53 disengage from the inclined surfaces 62*a* of the pawls 62 so that the pawls mesh with the engaging teeth 38 at the desired positions of the engaging plate 36 by the spring 63, so that the engaging plate 36 is locked. Thus the band is adjusted at a set length.

Another adjusting method is to push the depressing portions 54 of the manipulating member 43 and pull out the length adjusting section 11 from the surface cover 13 and release the depressing portions 54 as shown in FIG. 14. Each of the pawls then engages with one of the engaging teeth 38 so that the engaging plate 36 is locked. The adjusting section 11 is thereafter pushed into the surface cover 13 so as to the set the band to the size of the wrist. The inclined surfaces

38*a* of the engaging teeth 38 then push the inclined surfaces 62*a* of the pawls 62, thereby moving the pawls in the lateral direction of the band. Accordingly, the inclined surfaces 62*a* of the pawls 62 push the operation transmitting portions 66 of the sliding portion 53 outward, thereby moving the manipulating member 43 against the urging of the spring 56. When the pawls 62 overcome the engaging teeth with which the pawls initially meshed, pawls urged by the spring 63 move outward and mesh with the teeth next to the teeth with which the pawls initially meshed. Thus, if the length adjusting section 11 is pushed into the outer cover 13, the pawls overcome the teeth one after another. When the length adjusting section 11 is forced into the surface cover 13 to the position which meets the size of the wrist, the buckle can be adjusted at the appropriate position.

If the user attempts to pull out the length adjusting section 11 from the surface cover 13, the engaging surfaces 38*b* of the engaging teeth 38 formed in the lateral direction of the band abut against the engaging surfaces 62*b* of the pawls 62 formed in the lateral direction of the band, thereby preventing the length adjusting section from moving. Hence the length adjusting section cannot be pulled out unless the manipulating member 43 is depressed.

Thus, when extending the length of the band, the manipulating member 43 is depressed and the length adjusting section 11 is pulled out, and when shortening the length, the length adjusting section 11 is simply pushed in without depressing the manipulating member 43.

In still another method where the length is adjusted while the band is worn on the wrist, the depressing portions 54 in the state shown in FIG. 12 are held so that the pawls 62 are disengaged from the engaging teeth. While in this state, the depressing portions 54 are thrust in the direction shown by the arrows so that the entire manipulating mechanism 32 is moved in the direction of the arrows. Then the annular size of the band can be enlarged and the band extended while maintaining the position of the length adjusting section 11 intact. The depressing portions 54 are released at an appropriate position to lock the length adjusting section 11. The band can be shortened by a reverse operation.

The engaging teeth 38 may be formed in the opposite direction so as to face the inclined surfaces 38*a* to the band 1 and to face the engaging surfaces 38*a* to the band 6. Thus there is provided a buckle where the length adjusting section 11 is pulled out of the surface cover 13 without depressing the manipulating member 43 to elongate the band, and the manipulating member 43 is depressed and the length adjusting section 11 pushed into the surface cover 13.

In addition, a surface formed in the lateral direction of the band similarly to the engaging surface 38*b* may be adopted instead of the inclined surface 38*a* in each engaging tooth. Hence there is provided a buckle wherein the manipulating member 43 must be depressed both for pulling the length adjusting section 11 from the surface cover 13 and pushing the length adjusting section 11 into the surface cover 13.

In the present embodiment, in the operation transmitting portions 66 and the pawls 62 which constitute the operation converting means, the inclined surface 62*a* is formed in each pawl. However, the inclined surface 62*a* may be formed in the operation transmitting portions 66.

Although the above described embodiment is an example where the present invention is applied to a buckle for a watch, the present invention may be applied to other adornment bands such as bracelets and others.

Figure 15:
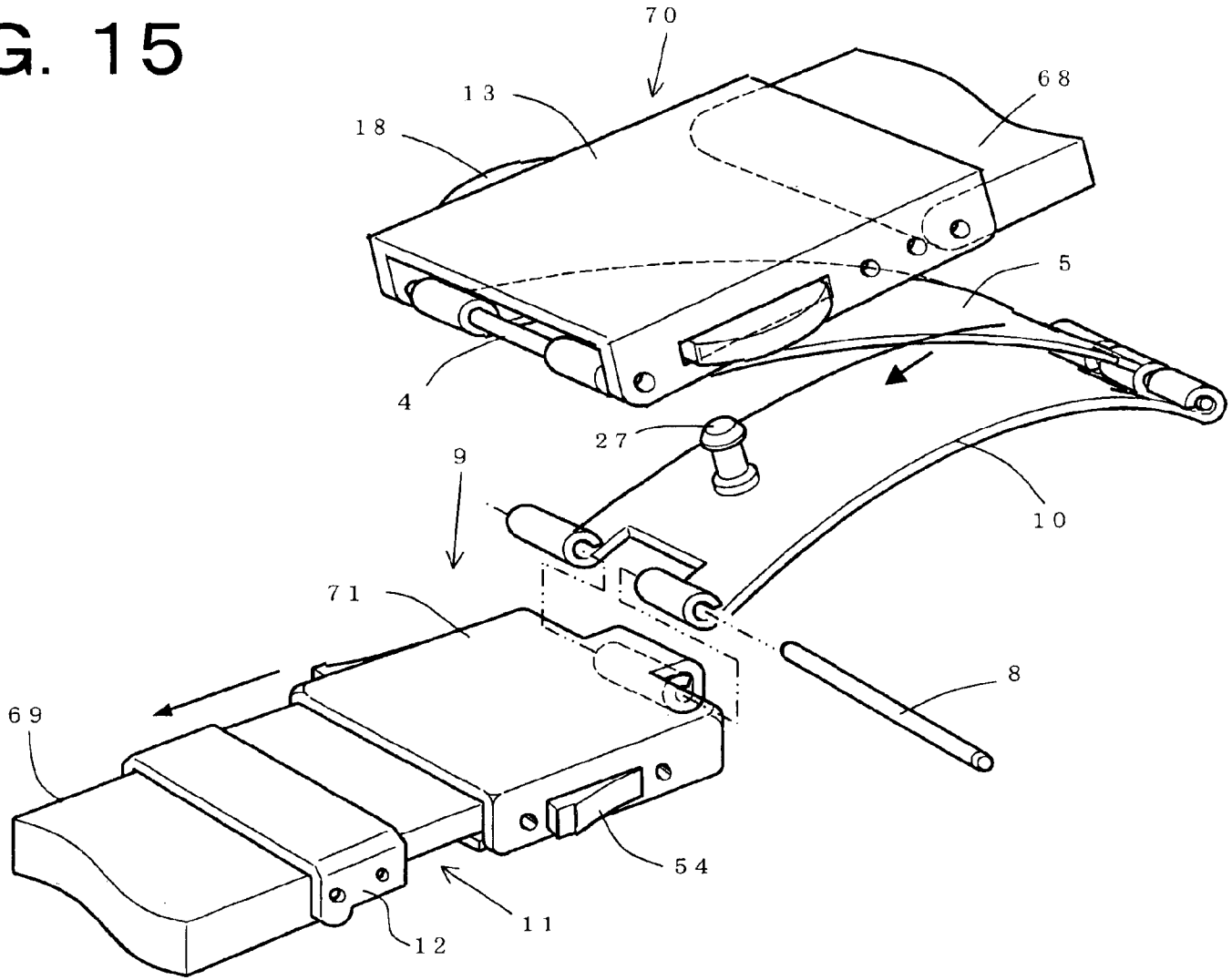
FIG. 15 is a perspective view showing a second embodiment of the present invention.
Figure 16:
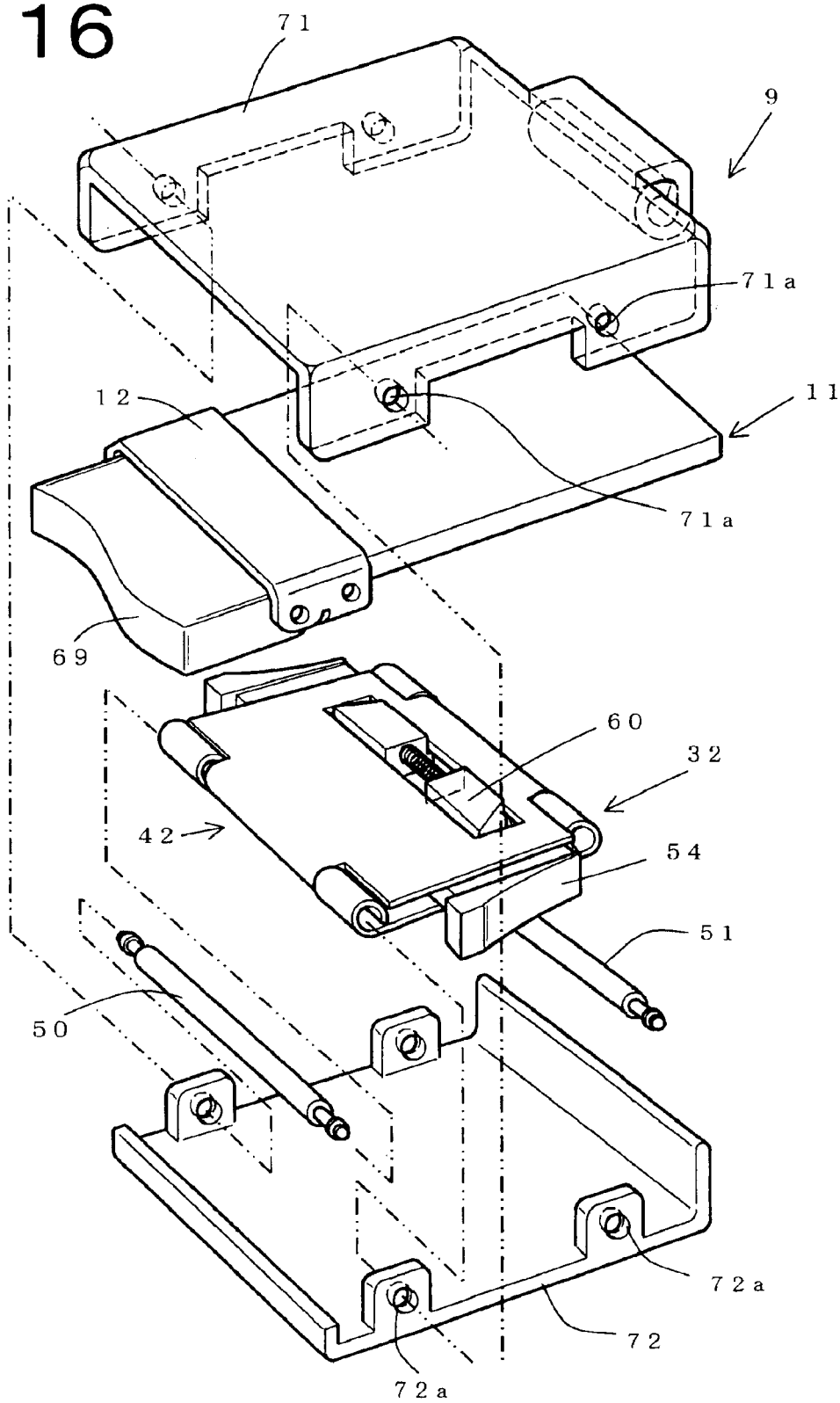
FIG. 16 is an exploded perspective view of length adjusting device.
Figure 17:
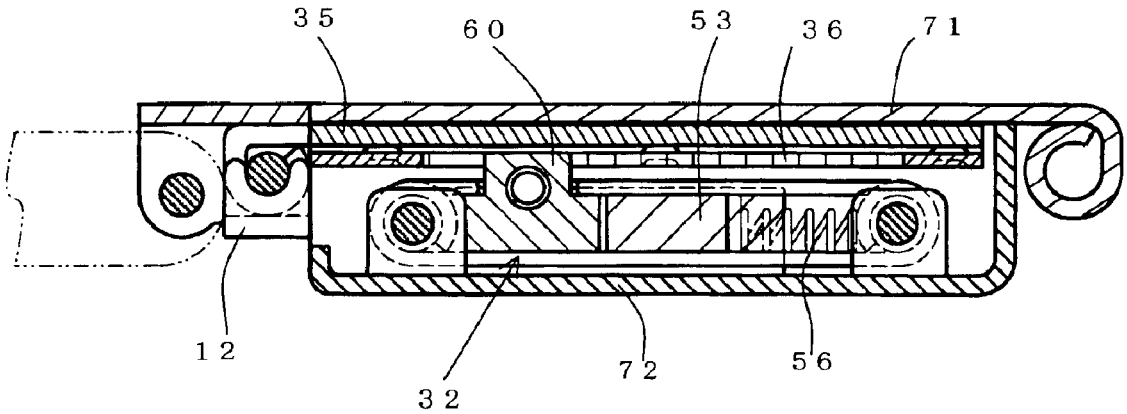
FIG. 17 is a sectional view thereof taken along the longitudinal direction.
Figure 18:
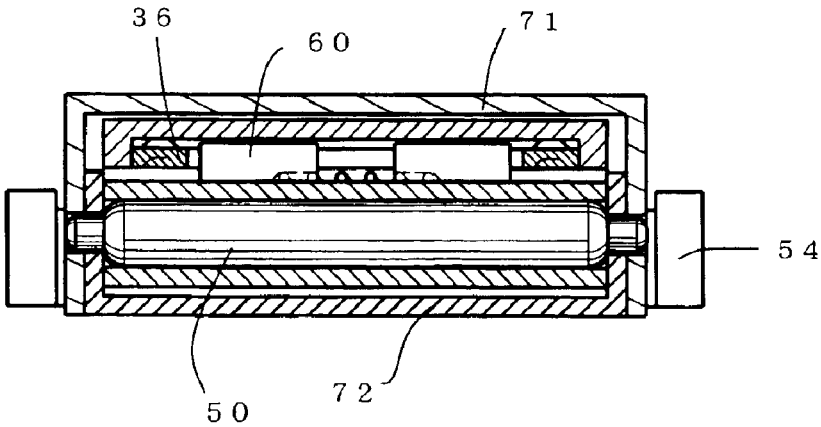
FIG. 18 is a sectional view thereof taken along the lateral direction thereof.

FIG. 15 is a perspective view showing a second embodiment of the present invention, FIG. 16 is an exploded perspective view of a length adjusting device, FIG. 17 is a sectional view taken along the longitudinal direction, and FIG. 18 is a sectional view taken along the lateral direction.

In the present embodiment, the length adjusting device 9 is provided between a buckle 70 connected to one end of a band 68 and another band 69. Namely, the triple-folded buckle 70 shown in FIG. 15 is a part of a buckle formed independently from the triple-folded buckle shown in FIGS. 1 and 2 and the same parts as those in FIGS. 1 and 2 are shown by the same references, thereby omitting the descriptions thereof. In the present embodiment, the length adjusting device is independently constructed and the length adjusting device has a housing comprising an upper housing 71 which is connected to the lower plate 10 of the buckle 70 by the spring-loaded pin 8 and a lower housing 72. The manipulating mechanism 32 having the identical structure as the manipulating mechanism 32 of the first embodiment is disposed between the housings 71 and 72, and secured thereto by inserting the spring-loaded pins 50 and 51 in holes 71*a* formed in side walls of the upper housing and holes 72*a* formed in upright portions of the lower housing 72, respectively.

The length adjusting section 11 is slidably inserted between the upper housing 71 and the manipulating mechanism 32 and the length adjusting section 11 is connected to an end of the other band 69 by the connecting member 12.

Other constructions are the same as the first embodiment so that the same parts as those of the first embodiment are designated by the same references, thereby omitting further explanation.

In the present embodiment, since the length adjusting device is formed separately from the buckle, the longitudinal length of the buckle becomes shorter than in the first embodiment, and in the case of a watch, even a person with a small wrist can wear the watch to fit the wrist without losing comfort.

Figure 19:
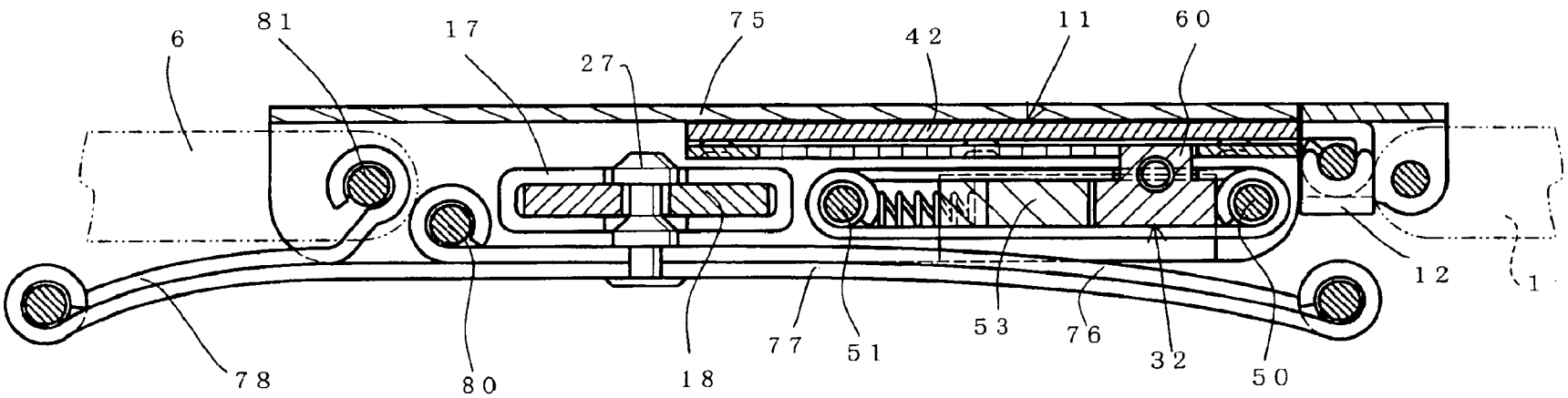
FIG. 19 is a sectional view of a third embodiment taken along the longitudinal direction of the band.

FIG. 19 is a sectional view of a third embodiment taken along the longitudinal direction of the band. In the present embodiment, the buckle of the first embodiment is adapted to a so-called opposed buckle. The buckle has a surface cover 75 having the housing 42 therein, in which the length adjusting section 11, manipulating mechanism 32 and the buckle lock device of the first embodiment are housed. The length adjusting section 11 is connected to the band 1 through the connecting member 12. The surface cover 75 is connected to a first middle plate 76 through a pin 80, and the middle plate 76 is in turn connected to a second middle plate 78 by way of a lower plate 77. The middle plate 78 is connected to the other band 6 by a pin 81.

Other constructions are the same as the first embodiment and the same parts are designated by the same references. Thus, when the lock pin 27 of the lock device releases the push buttons 18, the surface cover 75 is raised, thereby to open the middle plates 76 and 78 in both directions.

Figure 20:
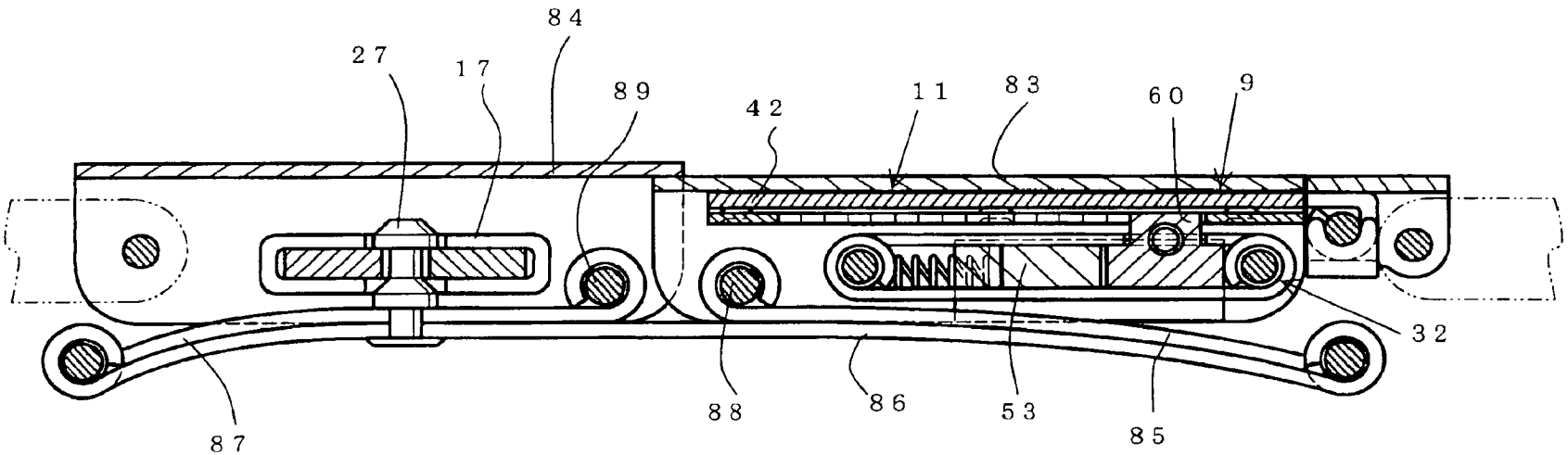
FIG. 20 is a sectional view of a fourth embodiment taken along the longitudinal direction of the band.

FIG. 20 is a sectional view of a fourth embodiment taken along the longitudinal direction thereof. Although also an opposed buckle, this buckle is divided into a first surface cover 83 and a second surface cover 84. In the housing 42 formed in the first surface cover 83, the length adjusting device 9 of the present invention is provided, and in the second surface cover 84, the buckle lock device is provided. The first surface cover 83 is connected to a first middle plate 85 by a pin 88 and the first middle plate 85 is connected to a second middle plate 87 through a lower plate 86. The second middle plate is connected to the second surface cover 84 by a pin 89.

In the locked condition shown in the figure, an end of the second surface cover 84 overlaps with the first surface cover 83 so as to prevent the first surface cover from opening. Other constructions are the same as the third embodiment.

Figure 21:
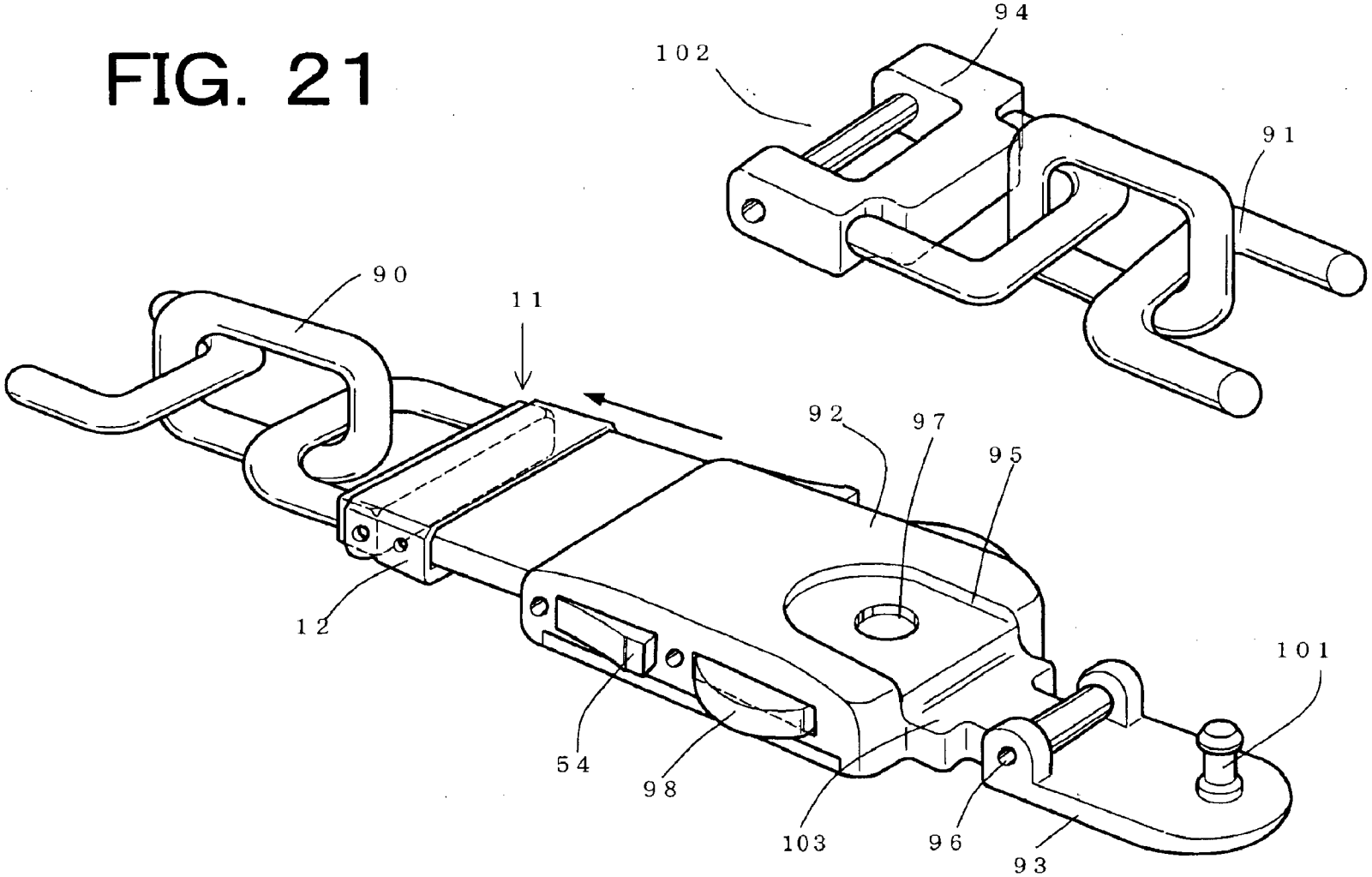
FIG. 21 is a perspective showing a fifth embodiment of the present invention adapted to a connecting type buckle.
Figure 22:
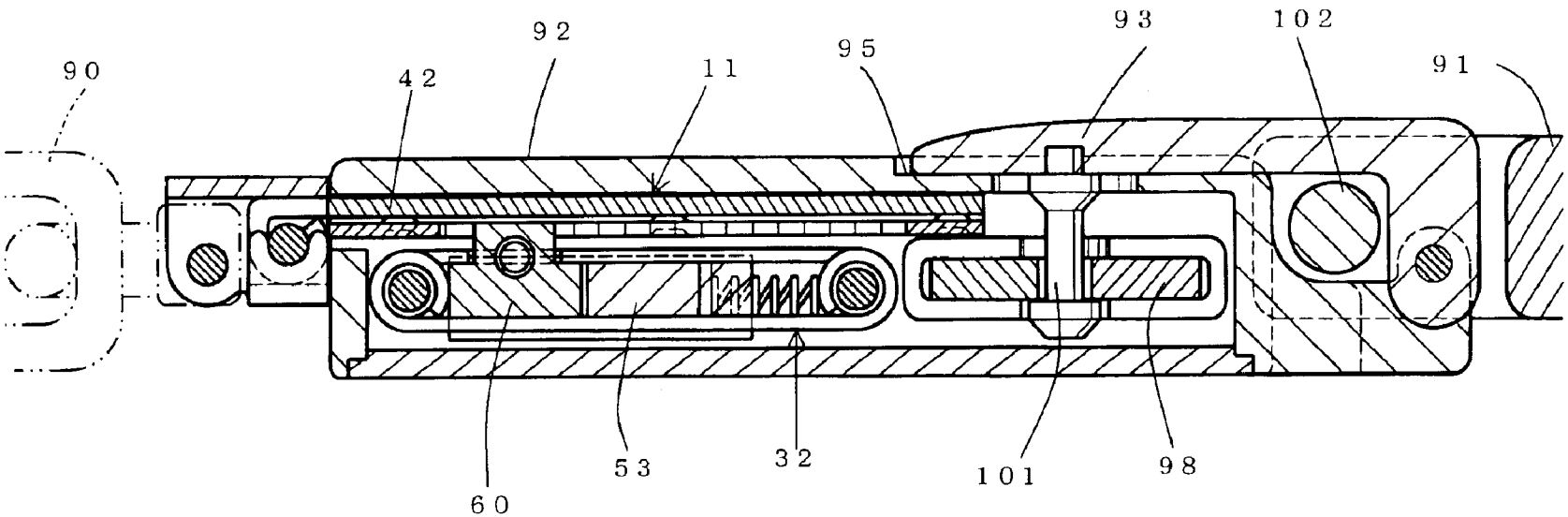
FIG. 22 is a sectional view thereof taken along the longitudinal direction thereof.

FIG. 21 is a perspective showing a fifth embodiment of the present invention adapted to a connecting type buckle, and FIG. 22 is a sectional view thereof taken along the longitudinal direction thereof. The buckle comprises a supporting member 92 having the length adjusting section 11 rotatably connected to an end of a band 90 by a pin, a surface cover 93 rotatably connected to an end of the supporting member 92 by a pin 96, a connecting link 94 connected to another band 91. The supporting member 92 has the length adjusting section 11 and the manipulating mechanism 32 disposed in the housing 42 and designated by the same references as in the previous embodiments.

In the upper surface of the supporting member 92, there is formed a recess 95 with which the surface cover 93 is to be engaged. In the recess 95, a circular opening 97 for communication with the lock device is provided in the buckle. The internal lock device has the same construction as that of the first embodiment.

The surface cover 93 has a lock pin 101 on the underside thereof, and the lock pin 101 has a semispherical head corresponding to the opening 97 of the recess 95. A connecting shaft 102 is laterally formed in the connecting link 94.

In order to connect the buckle, the surface cover 93 is inserted from the underside into a space of the connecting link 94 formed at the inner side of the connecting shaft 102. The connecting shaft 102 is thus disposed on a supporting arm 103 projecting from the supporting member 92 and the surface cover 93 is rotated about the pin 96 over the connecting shaft 102. The surface cover 93 is depressed to abut against the recess 95, and the lock pin 101 is inserted in the opening 97 of the recess and engaged with hooks of a pair of push buttons 98, and therefore, locked.

In order to unlock the buckle, the push buttons 98 are simultaneously depressed so that the lock is released, and the surface cover 93 is disengaged in the reverse order of the above description.

Figure 23:
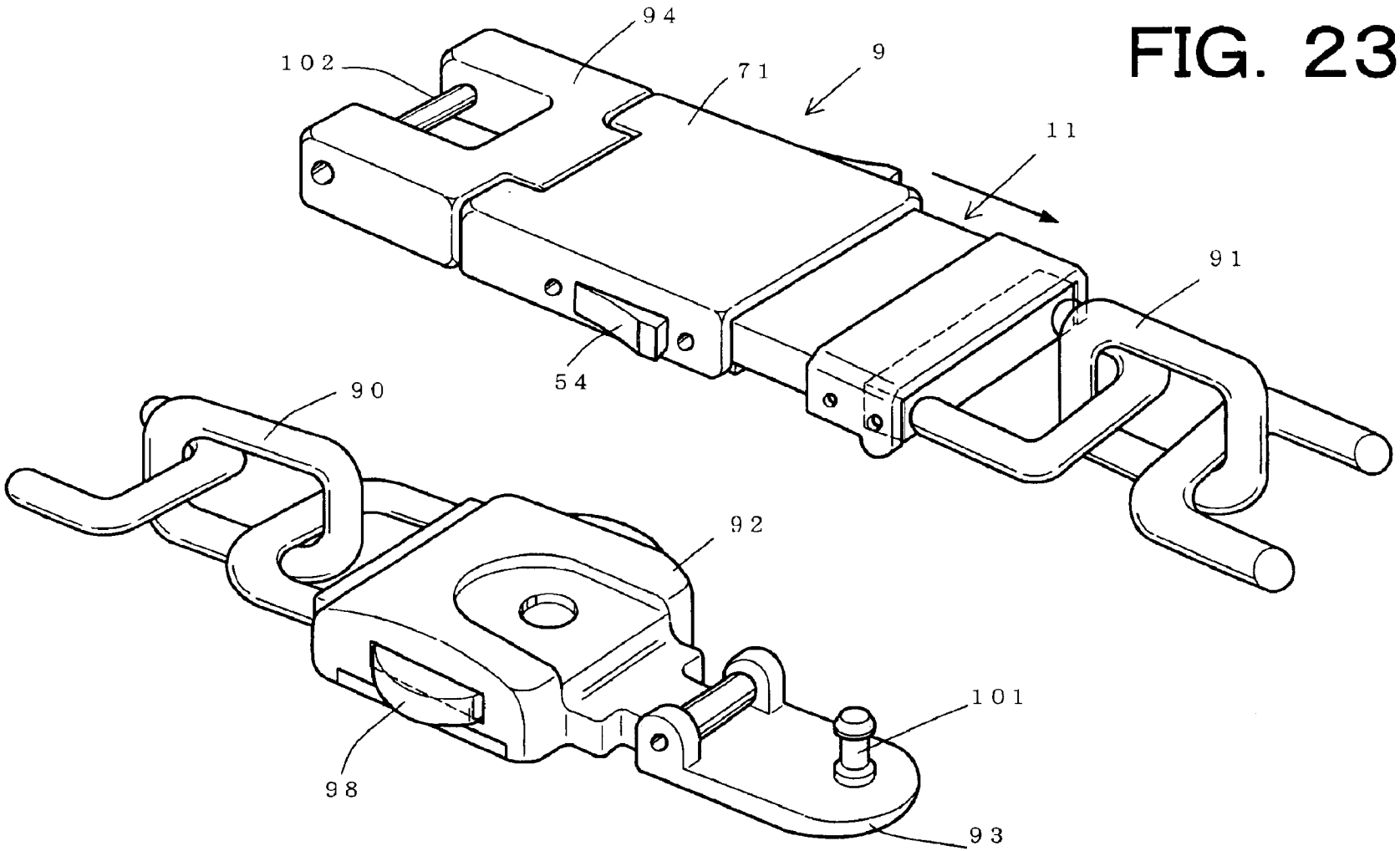
FIG. 23 is a perspective view showing a sixth embodiment.

FIG. 23 is a perspective view showing a sixth embodiment. In the embodiment, the length adjusting device is separated from the lock device as in the second embodiment and the length adjusting device 9 is provided between the end of the band 91 and the connecting link 94. The parts in FIG. 23 that are the same as in FIGS. 15 and 21 are designated by the same references and the descriptions thereof are omitted.

Figure 24:
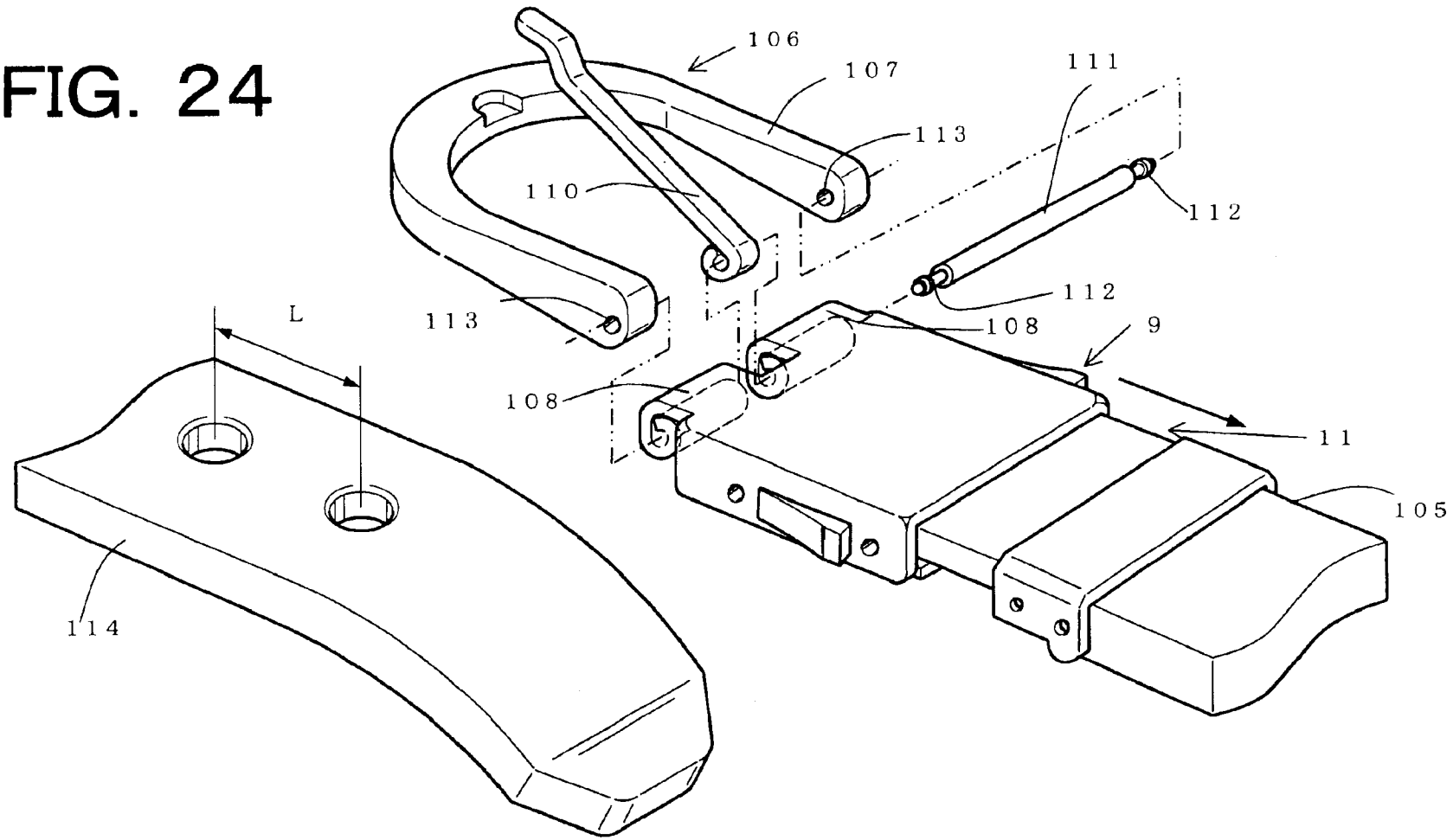
FIG. 24 is a perspective view showing a seventh embodiment.

FIG. 24 is a perspective view showing a seventh embodiment. The present embodiment is an example where the present invention is adapted to a buckle of a leather band and the length adjusting device 9 is connected to an end of a leather band 105. At the other end of the length adjusting device, there are formed a pair of connecting projections 108 which are connected to a frame 107 of a buckle 106. The connecting projections 108 are inserted in the frame 107 and a tongue 110 is disposed between the projections. A spring-loaded pin 111 is inserted in holes of the connecting projections 108 and in a hole formed in a base of the tongue. Pins 112 at the ends of the spring-loaded pin 111 engage with holes 113 in the frame 107 so that the length adjusting device 9 is connected to the band. The adjusting pitch of the length adjusting device is set to be shorter than a pitch L of the holes formed in another band 114.

Figure 25:
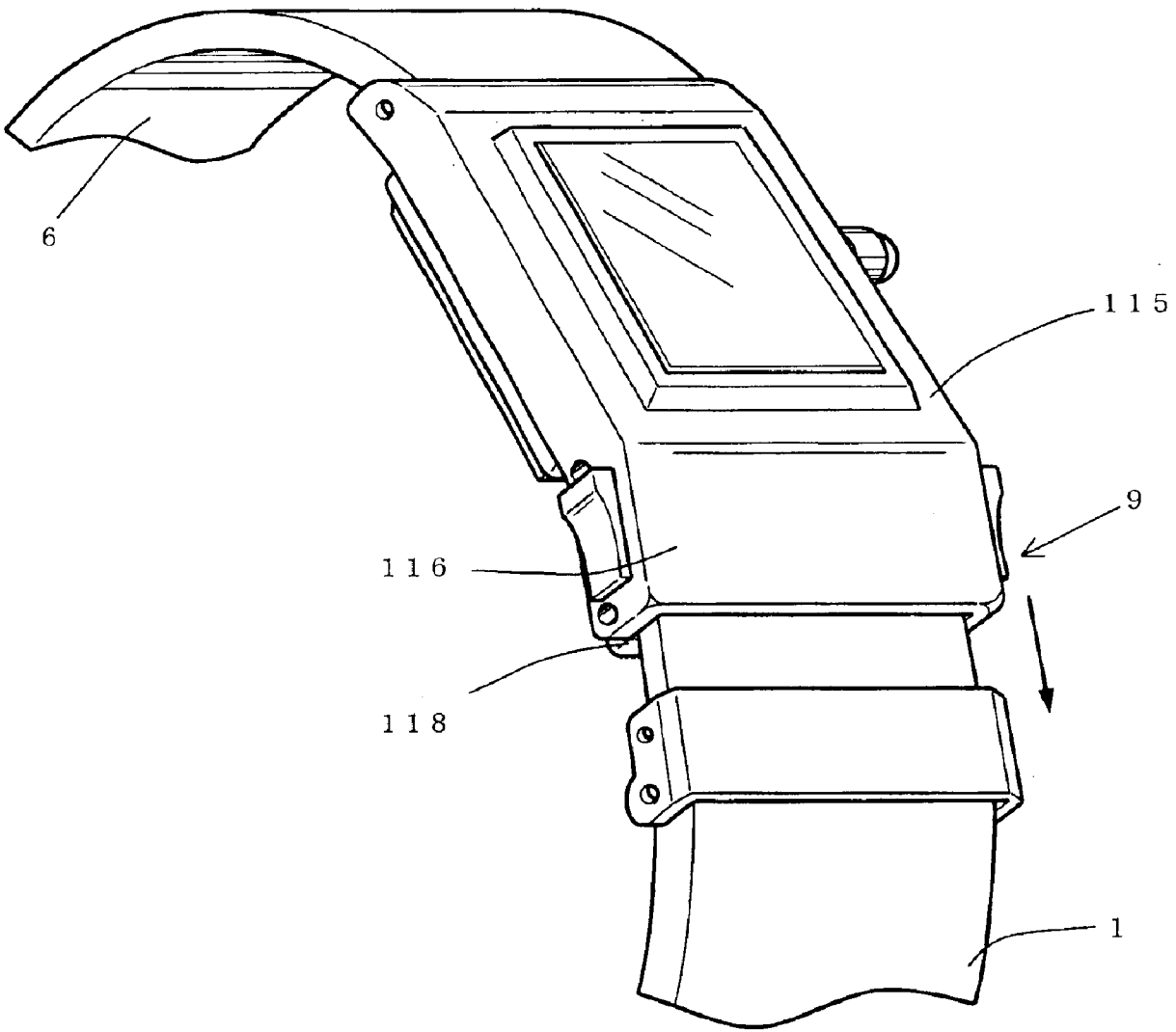
FIG. 25 is a perspective view showing an eighth embodiment.
Figure 26:
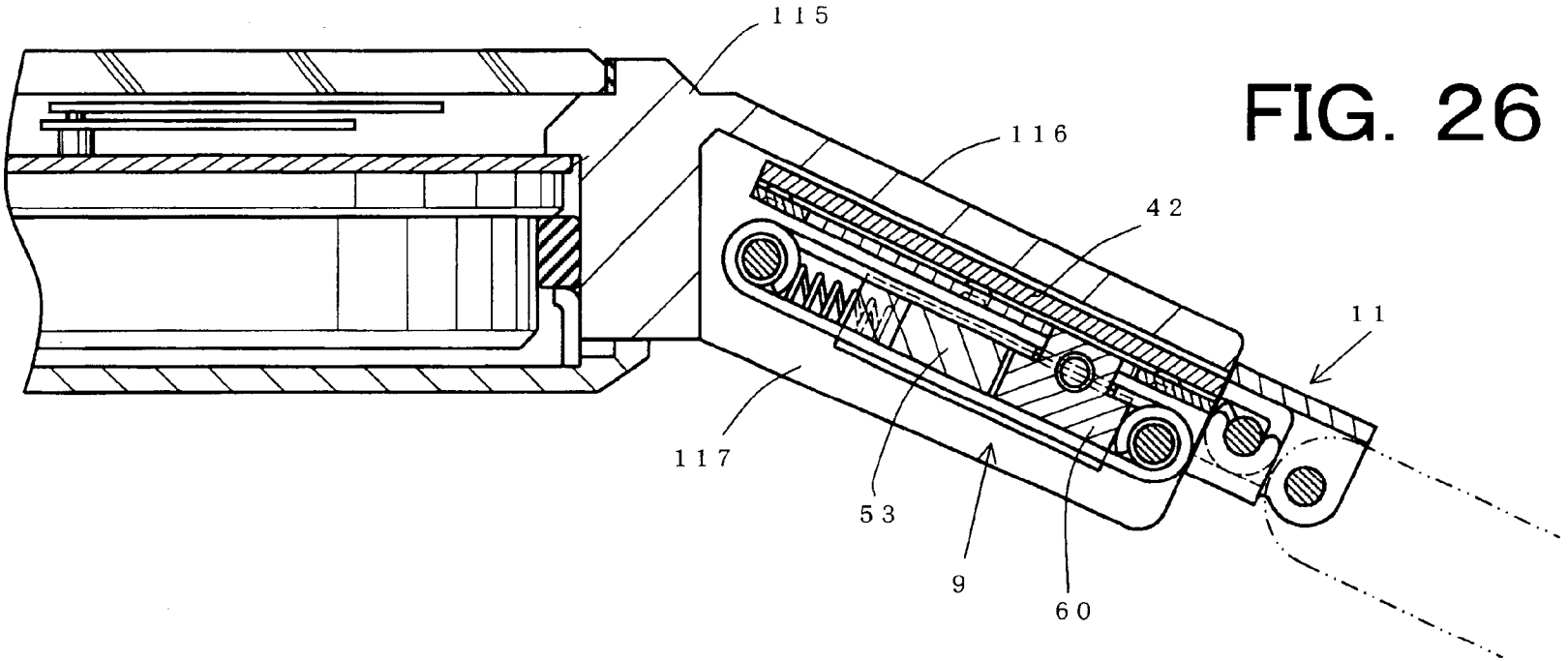
FIG. 26 is a sectional view taken along the longitudinal direction thereof.

FIG. 25 is a perspective view showing an eighth embodiment, and FIG. 26 is a sectional view taken along a longitudinal direction thereof. The present embodiment is an example where the length adjusting device 9 is provided within a case 115 of a watch. More particularly, an extended portion 116 is formed at one of the ends of the case 115 and a housing space 117 is formed under the extended portion. The length adjusting device 9 of the present invention is disposed in the housing space 117. Although the length adjusting device 9 is exposed at the underside thereof in FIG. 26, a cover 118 may be provided at the underside as shown in FIG. 25.

Figure 27:
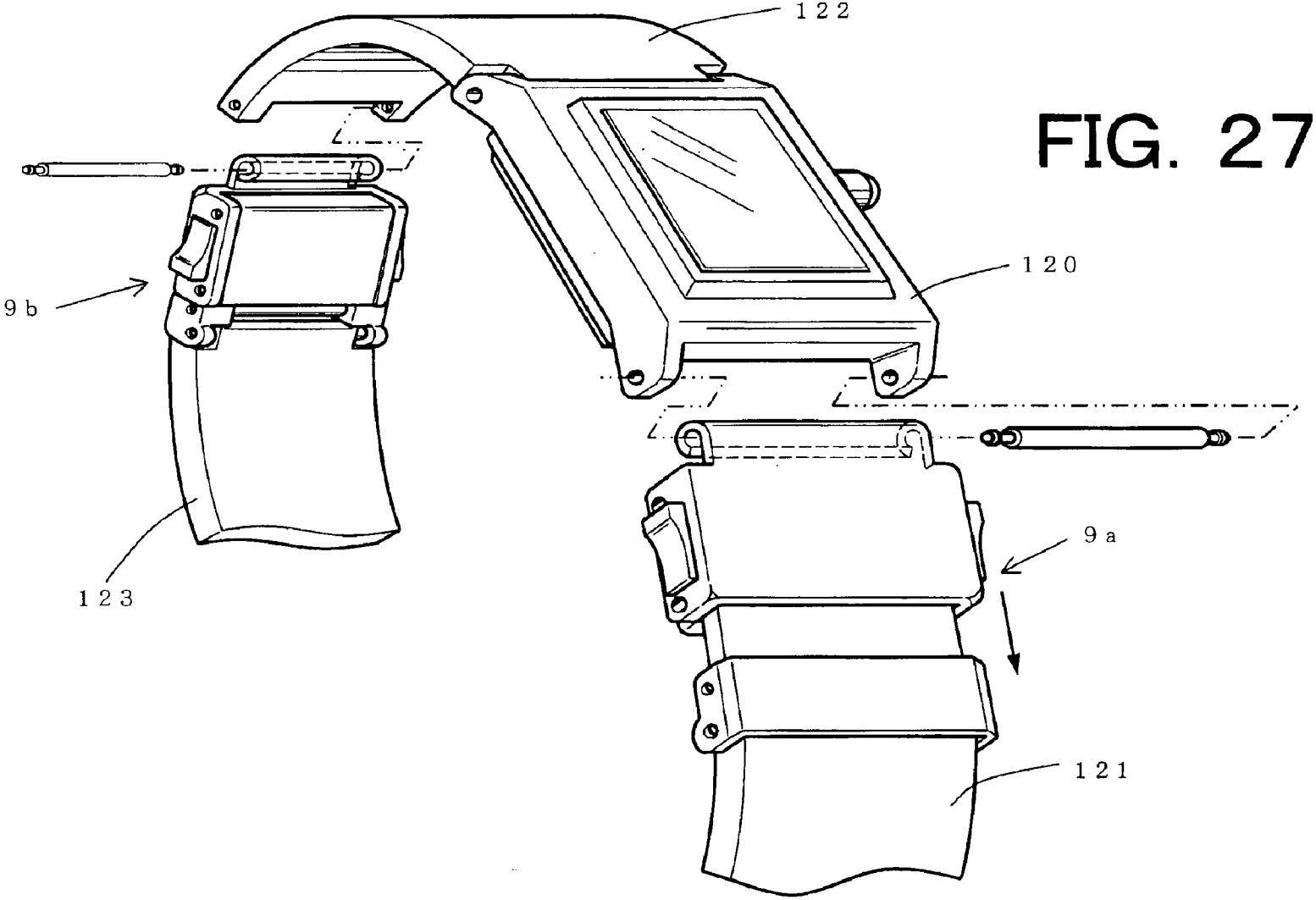
FIG. 27 is a perspective view showing a ninth embodiment.

FIG. 27 is a perspective view showing a ninth embodiment. The present embodiment is an example where two length adjusting devices 9 are connected to bands. Namely, a first length adjusting device 9*a* is provided between a watch case 120 and a band 121 and a second length adjusting device 9*b* is provided between a first portion 122 of another band and a second portion 123 of the band. Each of the length adjusting devices has the same construction as that of the second embodiment shown in FIG. 15.

The number of the length adjusting device is not limited to two and the adjusting length can be increased with the increase of the number. In addition, an ornamental quality may be increased.

Figure 28:
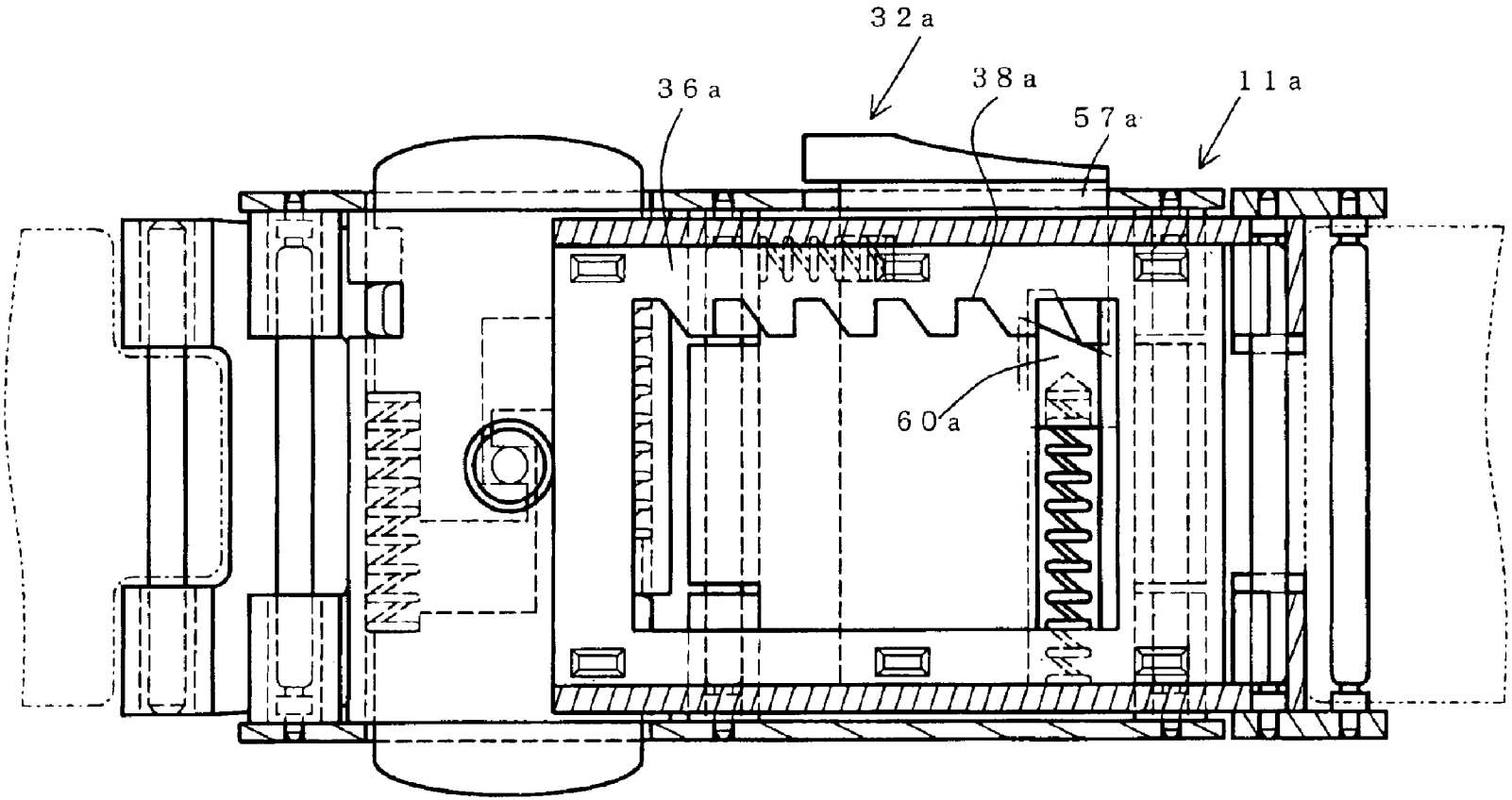
FIG. 28 is a sectional plan view of a tenth embodiment.

FIG. 28 is a sectional plan view of a tenth embodiment. In the present embodiment, engaging teeth 38*a* is formed only on one side of an engaging plate 36*a* of a length adjusting section 11. Hence, only one arm 57*a* and only one stopper member 60*a* are provided in a manipulating mechanism 32*a*. The operation and the effect do not differ although thus constructed.

Probability of Industrial Exploitation

In accordance with the present invention, since the manipulating member for adjusting the length of the personal adornment band is moved in the longitudinal direction of the band, the operation for adjusting the length is not mistaken for the operation of depressing the push buttons for unlocking the buckle. Thus the operability is improved. Moreover, the manipulating member is not operated when the wrist is bent so that the length of the personal adornment band is not accidentally increased.

What is claimed is:

1. A device for adjusting length of a personal adornment band comprising:

a guide means connected to an end of the personal adornment band;

a length adjusting section connected to another end of the personal adornment band and movably provided in a longitudinal direction of the personal adornment band and guided by the guide means;

a manipulating member provided in the guide means so as to be moved in the longitudinal direction of the personal adornment band;

an operation transmitting portion provided in the manipulating member;

at least one stopper member for making contact with a part of the length adjusting section to stop the length adjusting section; and an operation changing means provided at a contact portion between the manipulating member and the stopper member, the operation changing means being provided for moving the stopper member in a lateral direction of the band so as to contact the stopper member with the length adjusting section to lock the length adjusting section when the manipulating member is moved in one of longitudinal directions, and for moving the stopper member in another lateral direction to release the stopper member from the length adjusting section when the manipulating member is moved in another longitudinal direction.

2. The device according to claim 1 wherein the guide means is a housing.

3. The device according to claim 2 wherein a first urging means is provided for urging the manipulating member in one of longitudinal directions between a recess formed in the manipulating member and the housing.

4. The device according to claim 2 wherein at least one depressing portion is formed to operate the manipulating portion and the depressing portion projects out of the guide means.

5. The device according to claim 4 wherein a surface cover has an opening through which the depressing portions of the manipulating member are projected outward, and each depressing portion has a covering portion extended to cover at least a part of an edge of the opening.

6. The device according to claim 1 or 2 wherein the length adjusting section has a pair of engaging saw teeth formed in the longitudinal direction of the personal adornment band, and a pair of stopper members, each stopper member comprises a member having a pawl which moves in the lateral direction of the personal adornment band and engages with one of the engaging teeth, and two operation transmitting portions each adapted to operate the respective stopper member are provided.

7. The device according to claim 6 wherein the stopper member is movably disposed in a recess formed between a pair of arms formed in the manipulating member.

8. The device according to claim 6 wherein the manipulating member is provided with two depressing portions each projecting out of the guide means in opposite directions.

9. The device according to claim 6 having a surface cover for covering the guide means.

10. The device according to claim 9 wherein a foldable buckle is provided in the surface cover.

11. The device according to claim 10 wherein a pair of push buttons movable in the lateral direction thereof and a buckle lock device having a lock pin adapted to engage with hooks of the push buttons are provided in the surface cover.

12. The device according to claim 6 wherein an operation changing means is provided between each of the stopper members and the operation transmitting portion.

13. The device according to claim 6 wherein an opening is formed in the guide means and an upper portion of each pawl projects out of the opening, and the movement of each stopper member is guided by the movement of the pawl in the opening.

14. The device according to claim 6 wherein a part of the guide means is inserted in a groove formed in the manipulating member in the longitudinal direction of the personal adornment band so as to guide the movement of the manipulating member.

15. The device according to claim 6 wherein a first urging means is so provided to urge the manipulating member toward the end of the band.

16. The device according to claim 6 wherein each stopper member is guided by the guide means when moved.

17. The device according to claim 6 wherein the guide means is provided in a watch case.

18. The device according to claim 1 wherein the operation changing means comprises the operation transmitting portion projecting from the manipulating member and an inclined surface formed in the stopper member.

19. The device according to claim 18 wherein the inclined surface is a surface having a predetermined angle to the longitudinal direction of the personal adornment band.

20. The device according to claim 1 wherein the length adjusting section comprises:

an engaging plate having a vertically penetrating opening and provided with engaging teeth; and a ceiling plate adapted to overlap with the engaging plate to cover the opening.

21. The device according to claim 20 wherein the engaging plate is disposed in a recess formed in the underside of the ceiling plate, and adapted to engage with the ceiling plate.

22. The device according to claim 1 wherein a connecting member is connected to the length adjusting section, and the other end of the personal adornment band is rotatably connected to the connecting member.

23. The device according to claim 1 wherein a first urging means is provided to urge the manipulating member in one of longitudinal directions.

24. The device according to claim 23 wherein the first urging means is disposed adjacent the depressing portions so as to urge the depressing portion to the end of the band together with the manipulating member.

25. The device according to claim 1 wherein a second urging means is provided to urge the stopper member in a direction in which the stopper member abuts against the operation transmitting portion of the manipulating member.

26. The device according to claim 25 wherein the second urging means is disposed between two stopper members so as to urge the stopper member.

27. The device according to claim 25 wherein a second urging means is inserted in recesses formed in two stopper members so as to urge the stopper member.

28. A personal adornment band comprising:

a guide means;

a length adjusting section movably provided in a longitudinal direction and guided by the guide means;

a manipulating member provided in the guide means so as to be moved in the longitudinal direction;

an operation transmitting portion provided in the manipulating member;

at least one stopper member for making a contact with a part of the length adjusting section to stop the length adjusting section;

an operation changing means provided at a contact portion between the manipulating member and the stopper member, the operation changing means being provided for moving the stopper member in a lateral direction of the band so as to contact the stopper member with the length adjusting section to lock the length adjusting section when the manipulating member is moved in one of longitudinal directions, and for moving the stopper member in another lateral direction to release the stopper member from the length adjusting section when the manipulating member is moved in another longitudinal direction; and a band, one end of which is connected to the guide means and the other end of which is connected to the length adjusting section.

29. The personal adornment band according to claim 28 wherein an end of the band is a foldable buckle for expanding the band.

30. The personal adornment band according to claim 29 wherein the buckle and the length adjusting section are separately constructed.

31. The personal adornment band according to claim 28 wherein one end of the band is a watch case.

32. The personal adornment band according to claim 28 wherein one end of the band is a buckle.

33. The personal adornment band according to claim 32 wherein the buckle and the length adjusting section are separately constructed.

34. The personal adornment band according to claim 28 wherein two length adjusting sections are provided in an intermediate portion of the band.

35. A watch comprising:

a band;

a guide means connected to an end of the band;

a length adjusting section movably provided in a longitudinal direction of the band and guided by the guide means;

a manipulating member provided the guide means so as to be moved in the longitudinal direction of the band;

an operation transmitting portion provided in the manipulating member;

at least one stopper member for making a contact with a part of the length adjusting section to stop the length adjusting section; and an operation changing means provided at a contact portion between the manipulating member and the stopper member, the operation changing means being provided for moving the stopper member in a lateral direction of the band so as to contact the stopper member with the length adjusting section to lock the length adjusting section when the manipulating member is moved in one of longitudinal directions, and for moving the stopper member in another lateral direction to release the stopper member from the length adjusting section when the manipulating member is moved in another longitudinal direction.

36. A watchband comprising:

a guide means;

a length adjusting section movably provided in a longitudinal direction of the watchband and guided by the guide means;

a manipulating member provided in the guide means so as to be moved in the longitudinal direction of the watch band and;

an operation transmitting portion provided in the manipulating member;

at least one stopper member for making contact with a part of the length adjusting section to stop the length adjusting section;

an operation changing means provided at a contact portion between the manipulating member and the stopper member, the operation changing means being provided for moving the stopper member in a lateral direction of the band so as to contact the stopper member with the length adjusting section to lock the length adjusting section when the manipulating member is moved in one of longitudinal directions, and for moving the stopper member in another lateral direction to release the stopper member from the length adjusting section when the manipulating member is moved in another longitudinal direction; and a band, one end of which is connected to the guide means and the other end of which is connected to the length adjusting section.

* * * * *